US009921501B2

(12) United States Patent
Mochizuki et al.

(10) Patent No.: US 9,921,501 B2
(45) Date of Patent: Mar. 20, 2018

(54) TONER AND PROCESS FOR PRODUCING TONER

(71) Applicant: CANON KABUSHIKI KAISHA, Tokyo (JP)

(72) Inventors: Shinsuke Mochizuki, Yokohama (JP); Kenichi Nakayama, Numazu (JP); Masashi Kawamura, Yokohama (JP); Tsuneyoshi Tominaga, Suntou-gun (JP); Kunihiko Nakamura, Gotemba (JP); Tsutomu Shimano, Mishima (JP); Takayuki Toyoda, Suntou-gun (JP); Shiro Kuroki, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/457,159

(22) Filed: Mar. 13, 2017

(65) Prior Publication Data

US 2017/0269488 A1 Sep. 21, 2017

(30) Foreign Application Priority Data

Mar. 18, 2016 (JP) ..... 2016-055321

(51) Int. Cl.

| | |
|---|---|
| ***G03G 9/097*** | (2006.01) |
| ***G03G 9/08*** | (2006.01) |
| ***G03G 9/087*** | (2006.01) |
| ***G03G 9/09*** | (2006.01) |

(52) U.S. Cl.

CPC ..... *G03G 9/0806* (2013.01); *G03G 9/0819* (2013.01); *G03G 9/08711* (2013.01); *G03G 9/08755* (2013.01); *G03G 9/0918* (2013.01)

(58) Field of Classification Search

CPC ..... G03G 9/09791

See application file for complete search history.

(56) References Cited

U.S. PATENT DOCUMENTS

| | | | |
|---|---|---|---|
| 6,316,157 | B1 | 11/2001 | Yoshikawa et al. |
| 6,346,356 | B1 | 2/2002 | Ohno et al. |
| 7,112,393 | B2 | 9/2006 | Komoto et al. |
| 7,153,625 | B2 | 12/2006 | Kaburagi et al. |
| 7,387,860 | B2 | 6/2008 | Moriki et al. |

(Continued)

FOREIGN PATENT DOCUMENTS

| | | |
|---|---|---|
| JP | 2002-287429 | 10/2002 |
| JP | 2004-219507 | 8/2004 |

(Continued)

OTHER PUBLICATIONS

U.S. Appl. No. 15/393,455, filed Dec. 29, 2016, Tsutomu Shimano.
U.S. Appl. No. 15/420,651, filed Jan. 31, 2017, Yojiro Hotta.
U.S. Appl. No. 15/486,585, filed Apr. 13, 2017, Masatake Tanaka.

*Primary Examiner* — Hoa V Le

(74) *Attorney, Agent, or Firm* — Fitzpatrick Cella Harper and Scinto

(57) ABSTRACT

A toner having a toner particle which contains a binder resin, a fatty acid metal salt, and a resin having an ionic functional group, in which the fatty acid metal salt is a fatty acid metal salt of a polyvalent metal with valency of 2 or higher and a fatty acid with carbon atom number of at least 8 and not more than 28, and the acid dissociation constant pKa of the resin having an ionic functional group is at least 6.0 and not more than 9.0.

8 Claims, 3 Drawing Sheets

(56) References Cited

U.S. PATENT DOCUMENTS

| | | | |
|---|---|---|---|
| 7,846,631 | B2 | 12/2010 | Katsuka et al. |
| 7,858,283 | B2 | 12/2010 | Ishigami et al. |
| 7,927,775 | B2 | 4/2011 | Komatsu et al. |
| 7,939,233 | B2 | 5/2011 | Inoue et al. |
| 8,137,886 | B2 | 3/2012 | Baba et al. |
| 8,142,972 | B2 | 3/2012 | Hotta et al. |
| 8,288,069 | B2 | 10/2012 | Fujikawa et al. |
| 8,372,573 | B2 | 2/2013 | Ayaki et al. |
| 8,377,616 | B2 | 2/2013 | Tani et al. |
| 8,383,313 | B2 | 2/2013 | Ayaki et al. |
| 8,551,680 | B2 | 10/2013 | Ayaki et al. |
| 8,628,899 | B2 | 1/2014 | Kawamura et al. |
| 8,815,484 | B2 | 8/2014 | Tanaka et al. |
| 8,822,120 | B2 | 9/2014 | Abe et al. |
| 8,828,639 | B2 | 9/2014 | Kamikura et al. |
| 8,841,056 | B2 | 9/2014 | Yoshizaki et al. |
| 8,916,319 | B2 | 12/2014 | Ikeda et al. |
| 8,940,467 | B2 | 1/2015 | Hashimoto et al. |
| 8,986,914 | B2 | 3/2015 | Fujikawa et al. |
| 9,034,549 | B2 | 5/2015 | Shiotari et al. |
| 9,158,216 | B2 | 6/2015 | Shimano et al. |
| 9,079,989 | B2 | 7/2015 | Yasumatsu et al. |
| 9,261,806 | B2 | 2/2016 | Moribe et al. |
| 9,285,697 | B2 | 2/2016 | Fukudome et al. |
| 9,377,705 | B2 | 6/2016 | Shimano et al. |
| 9,383,668 | B2 | 7/2016 | Noji et al. |
| 9,423,708 | B2 | 8/2016 | Tominaga et al. |
| 9,500,972 | B2 | 11/2016 | Tanaka et al. |
| 9,575,424 | B2 | 2/2017 | Nakagawa et al. |
| 9,594,323 | B2 | 3/2017 | Fujikawa et al. |
| 9,599,919 | B2 | 3/2017 | Isono et al. |
| 2009/0246675 | A1 | 10/2009 | Nakamura et al. |
| 2010/0028796 | A1 | 2/2010 | Nakamura et al. |
| 2010/0035171 | A1 | 2/2010 | Watanabe et al. |
| 2010/0183971 | A1 | 7/2010 | Fujikawa et al. |
| 2013/0273188 | A1* | 10/2013 | Takahashi ..... B01J 2/04 425/7 |
| 2014/0356779 | A1 | 12/2014 | Hasegawa et al. |
| 2014/0377697 | A1 | 12/2014 | Nishiura et al. |
| 2015/0004539 | A1 | 1/2015 | Watanabe et al. |
| 2015/0099220 | A1 | 4/2015 | Abe et al. |
| 2015/0153669 | A1 | 6/2015 | Yoshida et al. |
| 2015/0248071 | A1 | 9/2015 | Katsura et al. |
| 2015/0286157 | A1 | 10/2015 | Masumoto et al. |
| 2015/0331344 | A1 | 11/2015 | Tominaga et al. |
| 2015/0370189 | A1 | 12/2015 | Tanaka et al. |
| 2016/0246192 | A1 | 8/2016 | Yoshida et al. |
| 2016/0246195 | A1 | 8/2016 | Shimano et al. |
| 2016/0299446 | A1 | 10/2016 | Kuroki et al. |
| 2016/0299447 | A1 | 10/2016 | Masumoto et al. |
| 2016/0349646 | A1 | 12/2016 | Yoshida et al. |
| 2017/0052465 | A1 | 2/2017 | Shimano et al. |
| 2017/0123333 | A1 | 5/2017 | Kuroki et al. |

FOREIGN PATENT DOCUMENTS

| | | |
|---|---|---|
| JP | 2009-139521 | 6/2009 |
| JP | 2014-098841 | 5/2014 |
| JP | 2014-222356 | 11/2014 |
| WO | 2015/145968 | 10/2015 |

* cited by examiner

TONER AND PROCESS FOR PRODUCING TONER

BACKGROUND OF THE INVENTION

Field of the Invention

The present invention relates to a toner used in image forming processes such as electrophotography, electrostatic recording, or a toner jet process, and to a process for producing the toner.

Description of the Related Art

A technique of visualizing image information via an electrostatic latent image, e.g. electrophotography, is widely used in various fields including a copying machine, a printer, and the like. In recent years, in addition to higher image quality, there are also demands for other added values such as reduction in the size and cost of a device. To achieve stable image density or stable tinge by an electrophotography mode, it is necessary to establish, in continuous fashion, a constant development condition for a development process. If there is an occurrence of an image fogging by which a toner is developed in a non-image part, in particular, this would be recognized as a decrease in image quality. Furthermore, as the toner consumption amount also increases, it is disadvantageous in terms of reduction in the size and cost of a device.

It is considered that eliminating the occurrence of fogging completely, i.e. having absolutely no toner developed in a non-image part, is an extremely difficult matter to achieve. Meanwhile, it is possible to reduce the fogging to a certain level at which the fogging is visually not recognizable. In this respect, various suggestions have conventionally been made in relation to means for suppressing fogging, and those techniques are basically means for reducing the fogging to a level at which the fogging is visually not recognizable. There are roughly two ideas related to suppression of fogging, one being based on potential control of a development system, and the other being based on charge quantity control of a toner.

First, explanations are given for the potential control of a general development system. In an image part, the toner is carried on a toner carrying member while it is charged either positively or negatively. Furthermore, in an image part, whether the toner is transferred onto an electrostatic image bearing member or stays on a toner carrying member is decided based on the potential of an electrostatic image bearing member, potential of a toner carrying member, and charge quantity of a toner. Here, by creating a difference between the potential of a toner carrying member and the potential of an electrostatic image bearing member of a non-image part, control is implemented such that the toner is prevented from being developed in a non-image part to the maximum possible extent. This potential difference is expressed with various terms such as fogging-removing potential, Vback potential, and back contrast. In the present specification, the term back contrast will be applied. Currently, while it is most probable that high image quality can be achieved in various environments by finely setting the back contrast control, this would also lead to the inevitable disadvantage of the potential control devices becoming more and more complicated. This being the case, there is demand for a toner with which fogging can be suppressed in a broad back contrast range.

Next, explanations are given with regard to control of toner charge quantity. The main reason for having undesired development of a toner in a non-image part results from the presence, in each particle of a toner, of a particle with insufficient charge quantity, or the presence therein of a particle which is charged to have reverse polarity to that of the image concept. A toner with insufficient charge quantity has a rather insensitive response to back contrast and, either statistically or based on an action of adhesion forces other than electrostatic force, it is thus transferred to a non-image part. Accordingly, a toner charged to have reverse polarity to the image concept is actively developed in a non-image part. To achieve a toner in which those inappropriate particles are suppressed as much as possible, various techniques relating to toner have been suggested.

As a control for charge quantity of a toner, a control based on a charge control agent is mainly employed, and suggestions have also been made for a toner containing a calixarene compound, a toner containing an azo dye which includes iron, a toner using an organoboron compound, or the like (for example, Japanese Patent Application Publication No. 2002-287429 and Japanese Patent Application Publication No. 2004-219507).

SUMMARY OF THE INVENTION

However, the aforementioned toners have insufficiencies in terms of a toner charge quantity or rising performance of charge quantity as they are affected by a change in temperature and humidity environments. As a result, there is also a case in which a problem such as image fogging caused by unevenness of charge quantity distribution under high humidity and high temperature condition occurs. A toner having a metal-containing polymer which includes am aromatic compound part in which a metal binds to a salicylic acid structure part or a salicylic acid derivative structure part, and a polymer part, has been suggested (see, Japanese Patent Application Publication No. 2014-098841). According to that, it is possible to obtain a toner of which charge quantity and rising performance of charge quantity are not likely to be influenced by a change in temperature and humidity environment. However, from the viewpoint of suppressing fogging in a broad back contrast range, there is still room for improvement.

Furthermore, for reducing the size and cost of a device, a toner with higher tinting strength than in the past is now receiving attention. By using a toner with nigh tinting strength, an image can be formed with a toner in less amount, and the size of a main body of a printer can be reduced and also energy saving can be achieved. However, when the amount of a pigment is simply increased, cost related to a toner may increase as the pigments are generally expensive. As such, extensive studies nave so far been made with regard, to a pigment dispersing agent. According to Japanese Patent Application Publication No. 2014-098841, there is exerted an effect of having a toner with favorable pigment dispersion in one toner particle. However, when considered in terms of the toner as a whole, there is still insufficiencies in the dispersion state, and thus there is room for improvement with regard to high tinting strength.

An object of the present invention is to provide a toner which can suppress fogging in a broad back contrast range under any environment including low temperature and low humidity environment to high temperature and high humidity environment, and which can exhibit its advantageous effects in sustained fashion through repeated use.

The above object is achieved by the present invention described below. That is, the present invention is a toner having a toner particle which contains a binder resin, a fatty acid metal salt, and a resin having an ionic functional group in which the fatty acid metal salt is a fatty acid metal salt of a polyvalent metal with valency of 2 or higher and a fatty acid with carbon atom number of at least 8 and not more than 28 and the acid dissociation constant pKa of the resin having the ionic functional group is at least 6.0 and not more than 3.0.

The present invention also relates to a process for producing a toner having a toner particle which contains a binder resin, a pigment, a fatty acid metal salt, and a resin having an ionic functional group, characterised in that the fatty acid metal salt is a fatty acid metal salt of a polyvalent metal with valency of 2 or higher and a fatty acid with carbon atom number of at least 8 and not more than 28, the acid dissociation constant pKa of the resin having the ionic functional group is at least 6.0 and not more than 9.0, and the process has the following step (i) or (ii).

(i) A step in which a polymerizable monomer composition containing a pigment, a fatty acid metal salt, a resin having an ionic functional group, and a polymerizable monomer for constituting a binder resin is granulated in an aqueous medium and the polymerizable monomer contained in a granulated particle is polymerized to give a toner particle.

(ii) A step in which a mixture solution containing a binder resin, a pigment, a fatty acid metal salt, and a resin having an ionic functional group, which is dissolved or dispersed in an organic solvent, is granulated in an aqueous medium and the organic solvent included in the granulated particle is removed to give a toner particle.

Further features of the present invention will become apparent from the following description of exemplary embodiments.

DESCRIPTION OF THE EMBODIMENTS

Figure 1:
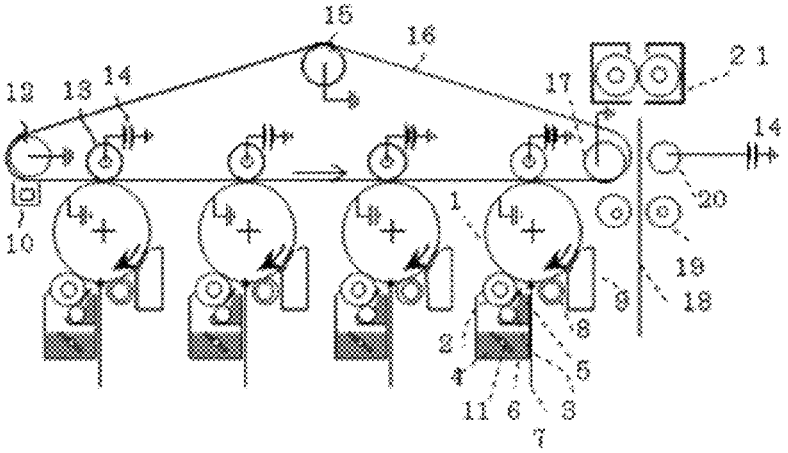
FIG. 1 is an example of an electrophotography device to which the present invention can be applied.

Hereinbelow, the present invention is explained in detail. In the present invention, a description such as "at least A and not more than B" or "A to B" representing a numerical range means a numerical range which includes both the lower limit and upper limit as an end point, unless described otherwise specifically.

The toner of the present invention is a toner having a toner particle which contains a binder resin, a fatty acid metal salt, and a resin having an ionic functional group, characterized in that the fatty acid metal salt is a fatty acid metal salt of a polyvalent metal with valency of 2 or higher and a fatty acid with carbon atom number of at least 8 and not more than 28, and the acid dissociation constant pKa of the resin having the ionic functional group is at least 6.0 and not more than 9.0.

The toner of the present invention can suppress fogging in a broad back contrast range.

First, explanations are given for the back contrast. As described above, the back contrast indicates a potential difference between a non-image part of an electrostatic image bearing member and a toner carrying member or a developer carrying member. Although it may vary depending on a system, the back contrast is generally set between 100 V or so and 200 V or so. Furthermore, as it is a very important control element for suppressing fogging, a controlling system for setting back contrast, by which use environment or use number is determined and optimum suppression of fogging can be exhibited, is generally installed.

When the back contrast is reduced, a dramatic increase in fogging is yielded, but it is a common phenomenon. That is because, as the back contrast is reduced, driving force required for returning a toner, which is in contact with an electrostatic image bearing member, to a toner carrying member is decreased. As such, back contrast with certain value or higher is required.

On the other hand, when the back contrast is increased, there can be a case in which fogging increases gradually. Depending on the case, there can be also a case in which a dramatic increase in fogging is yielded if the back contrast is higher than a certain value. This is due to the presence of a toner which is charged to have reverse polarity compared to the image concept.

In general, if various components for development or a toner is deteriorated, there can be a case in which the back contrast value to suppress fogging to a level at which fogging is not recognized as a problem is narrowed. For example, an assumption can be made for a system in which, at an initial stage of use, fogging is not visually recognized between back contrast of 80 V to 300 V. However, once various components for development or a toner starts to deteriorate through repeated use, a range of from 100 V to 130 V becomes the usable range and there can be a case in which fogging is recognized as a problem if the back contrast is outside the this range.

Although the degree may vary depending on the case, such narrowing of optimum back contrast value caused by deterioration through repeated use (this phenomenon is expressed as a decrease in fogging latitude in the present specification) is basically unavoidable. Furthermore, when the deterioration progresses to such an extent that the back contrast, which allows suppression of fogging so as not to be recognized as a problem, cannot be set, then based on the occurrence of this problem, the service life could be determined as having come to its end.

There can be also a case in which a change in fogging latitude is caused by a certain environment for use. In an environment with low humidity, the toner charge quantity is broad and thus the fogging occurs easily, so in some cases the back contrast may have to be set within a narrow range. On the other hand, in an environment with high humidity, a toner with low charge quantity is yielded either desired or not, so that there can be a situation in which the optimum back contrast is limited. Those characteristics are quite common for an electrophotographic device which uses a toner.

If it is possible to provide a toner by which fogging can be suppressed in si broad back contrast range, it would be easier to realize simplification of a development control system, a decreased use amount of a toner, simplification or minimization of a cleaning device, and so on. Next, the reason for which the toner of the present invention enables suppression of fogging in a broad back contrast range is examined.

With regard to the principle of fogging, if a condition is achieved in which a charge quantity inversion component is maintained at a conventional level or higher through repeated use or in various environments, it is believed that the fogging latitude can be broadened. However, by simply reducing the charge quantity inversion component in a toner, there can also be a case in which the fogging latitude does not significantly change.

In general, charge transfer occurs in a toner when it passes a point at which an electrostatic image bearing member is in the closest contact with a toner carrying member (in the present specification, such point is described as a development site). That is because, even for a case in which a toner on a toner carrying member passes a development site and this toner stays on the toner carrying member without being developed, a change in the charge quantity distribution is observed before and after the pass-through.

As a result of various investigations, it is demonstrated that the toner of the present invention shows a very insignificant change in charge quantity distribution before and after passing through a development site. Some recently found phenomenon provides evidence that a toner showing a change in charge quantity distribution before and after passing through a development site may have narrow fogging latitude (while detailed reasons thereof remain mostly unclear). Since it is difficult to measure an electrostatic quantity distribution at moments before and after the development due to passage of time during the measurement, the following mechanism is considered as an assumption. When a change in the toner charge quantity distribution is large at the time of passing through a development site and the fogging latitude is lowered, it is believed that a charge quantity inversion component is generated at the development site. That it because, if a charge quantity inversion component is not generated even when there is a change in the toner charge quantity distribution at the development site, it is believed that no significant change in the fogging latitude can be yielded. As such, if it is possible to maintain, through repeated use or in various environments, a state in which a charge quantity distribution on a toner carrying member is sharp and a charge quantity distribution at a development site shows no change (that is, no occurrence of any new charge quantity inversion component), a state with broad fogging latitude is presumed to be maintained.

The toner of the present invention contains a fatty acid metal salt of a polyvalent metal with valency of 2 or higher and a fatty acid with carbon atom number of at least 8 and not more than 28, and a resin having an ionic functional group of which acid dissociation constant pKa is at least 6.0 and not more than 9.0. It is believed that the characteristic of not having any change in electrostatic quantity distribution at a development site is obtained only based on such combination.

The writers assume the following as the reason for the above.

The ionic functional group in the resin having an ionic functional group may serve as a charge generating site in turboelectric charging. In the present invention, it is believed that the center metal of a fatty acid metal salt is adsorbed onto the ionic functional group and the charge generating site has a structure of "ionic functional group—metal—fatty acid". It is believed that, due to this structure, in particular due to the presence of a fatty acid, the charge accumulating property for maintaining generated charges is improved and toner charge exchange at the development site is suppressed. As a result, it is possible to obtain a toner which has a small change in charge quantity distribution before and after development and which has broad fogging latitude.

It is believed that the adsorption between the fatty acid metal salt and resin having an ionic functional group occurs under the Lewis's definition of acid and base. Namely, the center metal of the fatty acid metal salt is a Lewis acid and the ionic functional group with acid dissociation constant pKa of at least 6.0 and not more than 9.0 is a Lewis base, and the adsorption is based on an interaction between those acid and base.

It is believed that stronger adsorption between the fatty acid metal salt and resin having an ionic functional group is obtained as the complex stability between the fatty acid metal salt and resin having an ionic functional group becomes higher. As the charge of the center metal of fatty acid metal salt increases, higher complex stability is obtained. The effect is not obtained in the present invention if it is not a polyvalent metal with valency of 2 or higher.

Furthermore, because the resin having an ionic functional group functions as a Lewis base, higher complex stability can be obtained with higher acid dissociation constant pKa. If the pKa is lower than 6.0, metal adsorption property is insufficient so that the effect is not obtained. On the other hand, if the pKa is higher than 9.0, the hydrogen ion in an ionic functional group is not likely to undergo acid dissociation so that adsorption to the metal is inhibited. Furthermore, as the pKa is within the above range, the hygroscopic property of the ionic functional group is lowered so that an influence of moisture can be reduced. Accordingly, improved environmental stability, in particular, a sharp charge quantity distribution of a toner itself even in high temperature and high humidity condition, is obtained, and thus it is advantageous in terms of broadening of fogging latitude. The above pKa is preferably at least 7.0 and not more than 8.5. Furthermore, the pKa can be controlled based on the composition of the resin having an ionic functional group. Furthermore, the resin having an ionic functional group exhibits a negative chargeability.

The effect of the present invention is not obtained unless the carbon atom number of the fatty acid of fatty acid metal salt is at least 8 and not more than 28. In this regard, it is believed that the polarity of the fatty acid itself probably has an effect on the charge exchange at a development site. When the carbon atom number is less than 8, polarity of the fatty acid itself is high so that the charge accumulating property is not improved and, as the charge exchange at a development site is not suppressed, the fogging latitude is reduced. On the other hand, when the carbon atom number is more than 28, polarity of the fatty acid is excessively low so that the charge generation itself is suppressed, and as the charge quantity inversion component of a toner increases, the fogging latitude is reduced.

As for the fatty acid metal salt used in the present invention, any fatty acid me tail salt which has been known in a related art can be used without particular limitation as long as it is a fatty acid metal salt of a polyvalent metal with valency of 2 or higher and a fatty acid with carbon atom number of at least 8 and not more than 28. Specifically, as for the fatty acid, known acids including linear saturated fatty acid such as octanoic acid, nonanoic acid, lauric acid, stearic acid, behenic acid, or motannic acid, linear unsaturated fatty acid such as oleic acid or linoleic acid, and fatty acid with branch structure such as 15-methylhexyl decanoic acid can be used. Among them, linear saturated fatty acid with carbon atom number of at least 12 and not more than 22 is particularly preferable. Furthermore, the same effect can be obtained when one of those fatty acids binds to one center metal or a plurality of those fatty acid bind to the center metal.

As for the center metal, a known metal with valency of 2 or higher can be used. Preferably, it is a metal with valency of at least 2 and not more than 4, and a metal with valency of 2 or 3 is more preferable. With regard to a typical element, those having higher valency and smaller ionic radius have higher complex stability, and thus Al, Ba, Ca, Mg, and Zn are preferable. In addition to them, a transition metal such as Fe, Ti, Co, and Zr can have a stable unpaired electron in d orbital and has high complex stability, and therefore desirable. Namely, the polyvalent metal with valency of 2 or higher to be contained in the fatty acid metal salt is preferably selected from the group consisting of Al, Ba, Ca, Mg, Zn, Fe, Ti, Co, and Zr.

With regard to the toner of the present invention, content of the resin having an ionic functional group and fatty acid metal salt is preferably as follows relative to 100 parts by mass of the binder resin when the content of the resin having an ionic functional group is X parts by mass and the content of the fatty acid metal salt is Y parts by mass. X is preferably at least 0.10 and not more than 5.00, and more preferably at least 0.30 and not more than 3.00. Ratio between Y and X (Y/X) is preferably at least 0.050 and not more than 3.000, and more preferably at least 0.100 and not more than 2.000.

As the content of the resin having an ionic functional group is at least 0.10 parts by mass, there is a sufficient amount for charge control, and as it is not more than 5.00 parts by mass, broadening of charge quantity caused by charge up is not present.

Y/X represents the content of fatty acid metal salt relative to the resin having an ionic functional group. Excessive resin having an ionic functional group or fatty acid metal salt is present singly instead of being a structural body of "the resin having an ionic functional group-fatty acid metal salt", and thus it may cause an occurrence of charge exchange at a development site. As Y/X is at least 0.050, the structural body of "the resin having an ionic functional group-fatty acid metal salt" containing the resin having an ionic functional group and fatty acid metal salt can be present in a sufficient amount, and there is only a little amount of excessive resin having an ionic functional group, and thus desirable. Furthermore, as Y/X is not more than 3.000, there is only a little amount of excessive fatty acid metal salt, and thus desirable.

The resin having an ionic functional group can be any kind as long as it satisfies the aforementioned acid dissociation constant pKa. A method for obtaining the acid dissociation constant pKa will be described later, but it can be obtained from the results of neutralization titration.

For example, a resin having a hydroxyl group bound to an aromatic ring or a carboxy group bound to an aromatic group is preferable because it has the acid dissociation constant pKa within the above range. For example, a polymer of monomers containing at least one selected from the group consisting of vinyl salicylate, monovinyl phthalate, vinyl benzoate, and 1-vinyl naphthalene-2-carboxylic acid is preferable.

Furthermore, it is more preferable to contain a polymer which contains the ionic functional group represented by the following structural Formula (1) as a molecular structure.

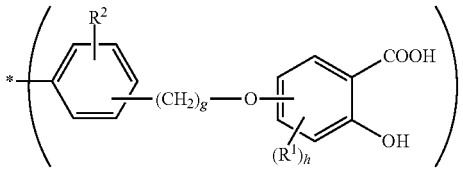

(1)

(In the Formula (1), $R^1$ each independently represents a hydroxyl group, a carboxy group, an alkyl group with carbon atom number of at least 1 and not more than 18, or an alkoxy group with carbon atom number of at least 1 and not more than 18, $R^2$ represents a hydrogen atom, a hydroxyl group, an alkyl group with carbon atom number of at least 1 and not more than 18, or an alkoxy group with carbon atom number of at least 1 and not more than 18, g is an integer of at least 1 and not more than 3 and h is an integer of at least 0 and not more than 3.)

Examples of the alkyl group for $R^1$ and $R^2$ include a methyl group, an ethyl group, a propyl group, an isopropyl group, a butyl group, an isobutyl group, a sec-butyl group, and a tert-butyl group, and examples of the alkoxy group include a methoxy group, an ethoxy group, and a propoxy group.

Furthermore, it is preferable for the resin having an ionic functional group that, when 0.10 g of the resin having an ionic functional group is dissolved in 150 ml of tetrahydrofuran (THF), pH of the THF solution is less than 7.0.

Content of the ionic functional group in one molecule of the resin having an ionic functional group is preferably at least 1% by mol and not more than 20% by mol based on the entire monomer units constituting the resin having an ionic functional group. When the ionic functional group is at least 1% by mol, a sufficient adsorption property of the ionic functional group onto a metal can be obtained. When the ionic functional group is not more than 20% by mol, an interaction between the ionic functional groups can be suppressed, and thus the effect of the present invention can be more easily exhibited. More preferably, the content is at least 3% by mol and not more than 8% by mol.

Hydrophobicity parameter HP of the resin having an ionic functional group is preferably at least 0.55 (HP indicates the volume fraction ratio of heptane at precipitation point of the resin having an ionic functional group when heptane is added to a solution containing 0.01 parts by mass of the resin having an ionic functional group and 1.48 parts by mass of chloroform). The hydrophobicity parameter can be measured according to the method which will be described later.

The hydrophobicity parameter is a numerical value representing the degree of hydrophobicity of the resin having an ionic functional group, and a higher numerical value indicates higher hydrophobicity. In this case, it was found that, as the hydrophobicity parameter HP is at least 0.55, a favorable transferability is obtained even under high temperature and high humidity environment. Under high temperature and high humidity environment, in particular, after repeated use, the toner is affected by moisture and, as nonstatic adhesive force between the toner and a photosensitive member easily increases, the transferability may be easily deteriorated. As the resin having an ionic functional group has pKa of at least 6.0 and not more than 9.0 and hydrophobicity parameter HP of at least 0.55, it is believed that effect of moisture may be kept at low level even under high temperature and high humidity environment, and through repeated use, while the nonstatic adhesive force is greatly reduced and a favorable transferability can be obtained. Furthermore, the hydrophobicity parameter HP is more preferably at least 0.60. Upper limit is, although not particularly limited, preferably not more than 0.98 and more preferably not more than 0.95. The HP can be controlled based on the composition of the resin having an ionic functional group.

For the purpose of controlling the hydrophobicity parameter HP, it is preferable that the resin having an ionic functional group has in the molecule an alkoxycarbonyl group represented by the following Formula (2).

(2)

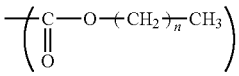

[In the Formula (2), n represents an integer of at least 3 and not more than 22.]

When the content of the alkoxycarbonyl group represented by the Formula (2) in one molecule of the resin having an ionic functional group is at least 1% by mol and not more than 30% by mol based on the entire monomer units constituting the resin having an ionic functional group, it is preferable in terms of balance between the ability to have hydrophobicity and adsorption performance for metal. More preferably, the content is at least by mol and not more than 10% by mol. Number of the alkoxycarbonyl group can be controlled by adjusting the injection ratio or molecular weight of a monomer at the time of synthesizing the resin having an ionic functional group. Furthermore, with the same reason as above, n in the Formula (2) is preferably at least 3 and not more than 22.

Preferred examples of the monomer containing an alkoxycarbonyl group to be am origin of the structure of the Formula (2) include alkyl ester of acrylic acid or methacrylic acid with carbon atom number of at least 4 and not more than 23. Examples thereof include butyl acrylate, stearyl acrylate, behenyl acrylate, butyl methacrylate, stearyl methacrylate, and behenyl methacrylate.

Structure of a main skeleton of the resin having an ionic functional group is not particularly limited, and examples thereof include a vinyl-based polymer, a polyester-based polymer, a polyamide-based polymer, a polyurethane-based polymer, and a polyether-based polymer. Also, a hybrid type polymer in which 2 or more of them are combined can be also exemplified. Among those exemplified herein, a vinyl-based polymer is preferable.

The resin having an ionic functional group can be synthesized by using, as a monomer, a compound having a polymerizable functional group like vinyl group on a substitution site of a group represented by the Formula (1), for example. In that case, the part represented by the Formula (1) is expressed by the following Formula (1-2).

(1-2)

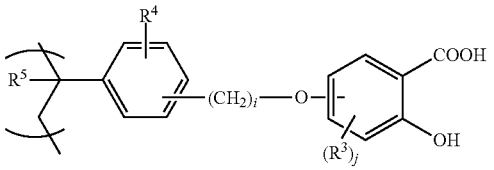

[In the Formula (1-2), $R^3$ each independently represents an alkyl group with carbon atom number of at least 1 and not more than 18 (preferably at least 1 and not more than 4), or an alkoxy group with carbon atom number of at least 1 and not more than 18 (preferably at least 1 and not more than 4), $R^4$ represents a hydrogen atom, a hydroxyl group, an alkyl group with carbon atom number of at least 1 and not more than 18 (preferably at least 1 and not more than 4), or an alkoxy group with carbon atom number of at least 1 and not more than 18 (preferably at least 1 and not more than 4). $R^5$ represents a hydrogen atom or a methyl group, i is an integer of at least 1 and not more than 3 and j is an integer of at least 0 and not more than 3.]

The weight average molecular weight Mw of the resin having an ionic functional group is preferably at least 10,000 and not more than 75,000. When it is at least 10,000, bleeding is inhibited through repeated use so that the durability is improved. When it is not more than 75,000, an even dispersion property of the resin in the toner is improved and the effect of broadening the fogging latitude can be easily exhibited. More preferably, it is at least 10,000 and not more than 50,000. The weight average molecular weight Mw of the resin having an ionic functional group can be controlled by modifying the reaction temperature, reaction time, monomer injection ratio, initiator amount or the like at the time of polymerization.

The binder resin which is used for the toner of the present invention is not particularly limited. Examples thereof include a styrene resin, an acryl-based resin, a styrene-acryl-based resin, a polyethylene resin, a polyethylene-vinyl acetate-based resin, a vinyl acetate resin, a polybutadiene resin/a phenol resin, a polyurethane resin, a polybutyral resin, and a polyester resin. Among them, from the characteristics of the toner, a styrene-based resin, an acryl-based resin, a styrene-acryl-based resin, a polyester resin or the like are preferable. As for the monomer of a styrene-based resin, an acryl-based resin, and a styrene-acryl-based resin, a polymerizable monomer of a suspension polymerization method which is described below can be used.

For the toner of the present invention, a pigment can be used. The pigment is not particularly limited, and well known pigments that are shown hereinbelow can be used.

Examples of a yellow pigment which can be used include yellow iron oxide, naples yellow, a condensed azo compound, such as naphthol yellow S, hansa yellow G, hansa yellow 10G, benzidine yellow G, benzidine yellow GR, a guinoline yellow lake, permanent yellow NCG, or tartrazine lake, an isoindoline compound, an anthraquinone compound, an azo metal complex, a methine compound, or an allyl amide compound. Specific examples thereof include the followings. C.I. Pigment Yellow 12, 13, 14, 15, 17, 62, 74, 83, 93, 94, 95, 109, 110, 111, 128, 129, 147, 155, 168, and 180.

Examples of an orange pigment include the following: permanent orange GTR, pyrazolone orange, Vulcan orange, benzidine orange G, indanthrene brilliant orange RK, and indanthrene brilliant orange GK.

Examples of a red pigment include bengala, condensed azo compounds such as permanent red 4R, lithol red, pyrazolone red, watching red calcium salt, lake red C, lake red D, brilliant carmine 6B, brilliant carmine 3B, eosine lake, rhodamine lake B, or alizarin lake, a diketopyrrolopyrrol compound, an anthraquinone compound, a quinacridone compound, a basic dye lake compound, a naphthol compound, a benzimidazolone compound, a thioindigo compound, and a perylene compound. Specific examples thereof include the followings. C.I. Pigment Red 2, 3, 5, 6, 7, 23, 48:2, 48:3, 48:4, 57:1, 81:1, 122, 144, 146, 166, 169, 177, 184, 135, 202, 206, 220, 221, and 254.

Examples of a blue pigment include alkali blue lake, Victoria blue lake, copper phthalocyanine compounds such as phthalocyanine blue, metal-free phthalocyanine blue, a partial chloride of phthalocyanine blue, fast sky blue, or indanthrene blue BG, and derivatives thereof, an anthraquinone compound, and a basic dye lake compound. Specific examples thereof include the followings. C.I. Pigment Blue 1, 7, 15, 15:1, 15:2, 15:3, 15:4, 60, 62, and 66.

Examples of a violet pigment include fast violet B and methyl violet lake.

Examples of a green pigment include Pigment Green B, malachite green lake, and final yellow green G.

Examples of a white pigment include zinc white, titanium oxide, antimony white, and zinc sulfide.

Examples of a black pigment include carbon black, aniline black, non-magnetic ferrite, magnetite, and a pigment toned to black with the above-mentioned yellow pigment, red pigment, and blue pigment Those pigments may be used either singly, or as a mixture or in the state of a solid solution.

Furthermore, the content of the pigment is preferably at least 3.0 parts by mass and not more than 10.0 parts by mass relative to 100 parts by mass of the binder resin or the polymerizable monomer constituting the binder resin.

Other than the resin having an ionic functional group, in the toner of the present invention, the following resins may be used within a range in which the effect of the present invention is not affected by them.

Homopolymers of styrene and substituted styrenes, such as polystyrene and polyvinyltoluene; styrene-based copolymers, such as a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-vinyl methyl ether copolymer, a styrene-vinyl ethyl ether copolymer, a styrene-vinyl methyl ketone copolymer, a styrene-butadiene copolymer, a styrene-isoprene copolymer, a styrene-maleic acid copolymer, or a styrene-maleate copolymer; and polymethyl methacrylate, polybutyl methacrylate, polyvinyl acetate, polyethylene, polypropylene, polyvinyl butyral, a silicone resin, a polyester resin, a polyamide resin, an epoxy resin, a polyacrylic resin, rosin, modified rosin, a terpene resin, a phenol resin, an aliphatic or alicyclic hydrocarbon resin, and an aromatic petroleum resin. They may be used either singly or as a mixture thereof.

The toner of the present invention may contain a charge control agent within si range in which the effect of the present invention is not affected by it. Examples of a charge control agent include a metal compound, of an aromatic carboxylic acid represented by salicylic acid, alkyl salicylate, dialkyl salicylate, naphthoic acid, and dicarboxylic acid; a metal salt or a metal complex of azo dye or azo pigment; a boron compound, a silicon compound, and calixarene. Furthermore, examples of a positive charge control agent include quaternary ammonium salt and a polymer type compound having quaternary ammonium salt; a guanidine compound; a nigrosine-based compound; and an imidazole compound.

The toner of the present invention may contain wax as a release agent. Exemplary types of wax include petroleum-based wax such as paraffin wax, microcrystalline wax, or petrolatum wax and derivatives thereof; montan wax and derivatives thereof; hydrocarbon wax based on Fischer Tropsch method, and derivatives thereof; polyolefin wax such as polyethylene wax and polypropylene wax, and derivatives thereof, natural wax such as carnauba wax or canderillia wax, and derivatives thereof; higher aliphatic alcohol; fatty acid such as stearic acid or palmitic acid; acid amide wax; ester wax; hydrogenated castor oil and derivatives thereof; plant-based wax; and animal-based wax. Among them, from the viewpoint of having an excellent release property, in particular, paraffin wax, ester wax, and hydrocarbon wax are preferable.

The content of a release agent is preferably at least 3 parts by mass and not more than 20 parts by mass relative to 100 parts by mass of the binder resin or polymerizable monomer constituting the binder resin.

For the purpose of improving the fluidity, the toner of the present invention may be added with a flowability improver. Exemplary types of the flowability improver include fluorine-based resin powder such as fine powder of vinylidene fluoride or fine powder of polytetrafluoroethylene; fatty acid metal salt such as zinc stearate, calcium stearate, or zinc stearate; metal oxide such as titan oxide powder, aluminum oxide powder, or zinc oxide powder, or powder obtained by hydrophobization of the metal oxide; fine powder of silica such as wet silica or dry silica, or fine powder of surface-treated silica in which the silica is surface-treated with a treating agent such as silane coupling agent, a titan coupling agent, or silicone oil.

The addition amount of such flowability improver is preferably at least 0.01 parts by mass and not more than 5.00 parts by mass relative to 100 parts by mass of the toner particle.

As means for producing the toner particle, a method conventionally known in the field can be used without particular limitation. In particular, a suspension polymerization method or a dissolution suspension method by which a toner is produced based on granulation in an aqueous medium can give a toner with even surface property while the toner maintains a sphere shape or a shape close to a sphere. Thus, the durability or charge quantity distribution of the toner is excellent and more excellent effect of broadening the fogging latitude is obtained.

Examples of the polymerizable monomer for obtaining the toner of the present invention by a suspension polymerization method include the followings.

An aromatic vinyl monomer such as styrene, vinyl toluene or α-methylstyrene; α,β-unsaturated carboxylic acid such as acrylic acid or methacrylic acid; derivatives of acrylic acid or methacrylic acid such as methyl acrylate, ethyl acrylate, propyl acrylate, butyl acrylate, 2-ethylhexyl acrylate, cyclohexyl acrylate, isobornyl acrylate, dimethylaminoethyl acrylate, methyl methacrylate, ethyl methacrylate, propyl methacrylate, butyl methacrylate, 2-ethylhexyl methacrylate, cyclohexyl methacrylate, isobornyl methacrylate, dimethylaminoethyl methacrylate, acrylonitrile, methacrylonitrile, acrylamide, or methacrylamide; ethylenically unsaturated, monoolefin such as ethylene, propylene, or butylene; vinyl halide such as vinyl chloride, vinylidene chloride, or vinyl fluoride; vinyl ester such as vinyl acetate or vinyl propionate; vinyl ether such as vinyl methyl ether or vinyl ethyl ether; vinyl ketone such as vinyl methyl ketone or methyl isopropenyl ketone; and nitrogen-containing vinyl compound such as 2-vinyl pyridine, 4-vinyl pyridine, or N-vinyl pyrrolidone.

The polymerizable monomer may be used either singly or in combination of 2 or more types. Among the monovinyl-based monomers, it is desirable to use an aromatic vinyl monomer in combination with acrylic acid ester or methacrylic acid ester.

In the case of obtaining the toner of the present invention by a suspension polymerization method, a polymerization initiator may be further used. Specific examples thereof include azo-based or diazo-based polymerization initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, or azobisisobutyronitrile; and peroxide-based polymerization initiators such as benzoyl peroxide, t-butyl peroxy 2-ethyl hexanoate, t-butyl peroxy pyvalate, t-butyl peroxy isobutyrate, t-butyl peroxy neodecanoate, methyl ethyl ketone peroxide, diisopropyl peroxycarbonate, cumene hydroperoxide, 2,4-dichlorobenzoyl peroxide, or lauroyl peroxide. Furthermore, to control the polymerization degree of the polymerizable monomer, it is also possible to further add a known chain transfer agent, a polymerization inhibitor, or the like for use.

In the case of obtaining the toner by a suspension polymerization method, an oil soluble initiator and/or a water soluble initiator is used as a polymerization initiator. Preferably, the half life of the polymerization initiator is 0.5 to 30 hours at a reaction temperature at the time of polymerization reaction. When the polymerization reaction is carried out with the polymerization initiator in an addition amount of 0.5 to 20.0 parts by mass relative to 100.0 parts by mass of the polymerizable monomer, a monomer with peak molecular weight of 10,000 to 100,000 is generally obtained, and a toner with suitable strength and melting properties can be obtained.

In the case of obtaining the toner of the present invention by a dissolution suspension method, the organic solvent which is used is not particularly limited as long as it can dissolve and/or disperse the toner composition. As a preferred organic solvent, a volatile solvent having boiling point lower than 150° C. is preferable from the viewpoint of easy removal.

As for the solvent, toluene, xylene, benzene, carbon tetrachloride, methylene chloride, 1,2-dichloroethane, 1,1,2-trichloroethane, trichloroethylene, chloroform, monochlorobenzene, methyl acetate, ethyl acetate, methyl ethyl ketone, acetone, tetrahydrofuran, and the like may be used either singly or in combination of 2 or more types thereof.

Furthermore, examples of the binder resin for such case include the followings. Styrene such as polystyrene, poly p-chlorostryene, or polyvinyl toluene, and a polymer of substitution product of styrene; a styrene-based copolymer such as a styrene-p-chlorostyrene copolymer, a styrene-propylene copolymer, a styrene-vinyl toluene copolymer, a styrene-vinyl naphthalene copolymer, a styrene-methyl acrylate copolymer, a styrene-ethyl acrylate copolymer, a styrene-butyl acrylate copolymer, a styrene-octyl acrylate copolymer, a styrene-methyl methacrylate copolymer, a styrene-ethyl methacrylate copolymer, a styrene-butyl methacrylate copolymer, a styrene-methyl α-chloromethacrylate copolymer, a styrene-acrylonitrile copolymer, a styrene-vinyl methyl ketone copolymer, a styrene-butadiene copolymer, a styrene-isoprene copolymer, a styrene-acrylonitrile-indene copolymer, a styrene-maleic acid copolymer, or a styrene-maleic acid ester copolymer; polymethyl methacrylate, polybutyl methacrylate, polyvinyl chloride, polyvinyl acetate, polyethylene, polypropylene, polyester, an epoxy resin, an epoxy polyol resin, polyurethane, polyamide, polyvinyl butyral, and a polyacrylic acid resin. They may be used either singly or as a mixture.

In the case of obtaining the toner by a suspension polymerization method or a dissolution suspension method, it is preferable to add an inorganic or organic dispersion stabilizer to the aqueous medium. Exemplary types of an inorganic compound which is used as a dispersion stabilizer include hydroxyapatite, tricalcium phosphate, dicalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. Exemplary types of an organic compound which is used as a dispersion stabilizer include polyvinyl alcohol, gelatin, methyl cellulose, methyl hydroxypropyl cellulose, ethyl cellulose, carboxymethyl cellulose sodium salt, polyacrylic acid and a salt thereof, and starch. Furthermore, to have fine dispersion of those dispersion stabilizers, a surfactant, may be used, and this is for promoting the initial activity of a dispersion stabilizer. Examples of the surfactant include sodium dodecyl benzene sulfate, sodium tetradecyl sulfate, sodium pentadecyl sulfate, sodium octyl sulfate, sodium oleate, sodium laureate, potassium stearate, and calcium oleate.

When an inorganic compound is used as a dispersion stabilizer, a commercially available product may be used directly. However, to obtain more fine particles, it is also possible that the above inorganic compounds are produced in an aqueous medium and used. In the case of hydroxyapatite or calcium phosphates such as tricalcium phosphate, it is desirable that an aqueous solution of phosphate is admixed with an aqueous solution of calcium salt under high stirring.

Next, explanations are given for the process for producing a toner of the present invention. For the present invention, it is preferable to use a suspension polymerization method or a dissolution suspension method.

Namely, the process for producing a toner of the present invention is a method for producing a toner having a toner particle which contains a binder resin, a pigment, a fatty acid metal salt, and a resin having an ionic functional group, characterized in that the fatty acid metal salt is a fatty acid metal salt consisting of a polyvalent metal with valency of 2 or higher and a fatty acid with carbon atom number of at least 8 and not more than 28, the acid dissociation constant pKa of the resin having an ionic functional group is at least 6.0 and not more than 9.0, and the process has the following step (i) or (ii).

(i) A step in which a polymerizable monomer composition containing a polymerizable monomer for constituting a binder resin, a pigment, a fatty acid metal salt, and a resin having an ionic functional group is granulated in an aqueous medium and the polymerizable monomer contained in a granulated particle is polymerized to give a toner particle.

(ii) A step in which a mixture solution having a toner composition containing a binder resin, a pigment, a fatty acid metal salt, and a resin having an ionic functional, group, which is dissolved or dispersed in an organic solvent, is granulated in an aqueous medium and the organic solvent included in the granulated particle is removed to give a toner particle.

According to the process for producing a toner of the present invention, a toner with even surface property is obtained while the toner maintains a sphere shape or a shape close to a sphere. Thus, the durability or charge quantity distribution of the toner is excellent and more excellent effect of broadening the fogging latitude is obtained. Furthermore, the pigment dispersion property in a toner is improved and the tinting strength of a toner is also improved.

The mechanism for having improved tinting strength according to the process for producing a toner of the present invention is believed to be as follows.

In general, a pigment in a toner easily causes re-aggregation in each process for producing a toner after a pigment dispersion step. In particular, according to a production method including a granulation process in an aqueous medium as described, above, a toner particle not incorporated with a pigment, that is, so-called empty shell, may be generated. Generation of an empty cell is the most important cause of having a decrease in tinting strength.

According to the production process of the present invention, the pigment, fatty acid metal salt, and the resin having an ionic functional group are evenly admixed with one another at the time of granulation in am aqueous medium. It is believed that, at that time, the fatty acid metal salt is adsorbed onto a surface of the pigment, the resin having an ionic functional group is adsorbed onto the fatty acid metal salt which has been adsorbed onto a surface of the pigment, and by forming a pigment modified state such as "pigment-fatty acid metal salt-resin having an ionic functional group", the effect of improving the tinting strength is obtained. It is believed that the fatty acid metal salt in this structure imparts to the pigment affinity for a solvent and the binder resin, and as the pigment is easily enclosed in the toner particle, generation of an empty shell is inhibited. It is also believed that repulsive force between the pigments is provided by the resin having an ionic functional group, and by inhibiting the re-aggregation of the pigments during the following steps, the pigment dispersion property is improved. As those two effects are added up, the tinting strength of the toner is greatly enhanced.

The adsorption between the pigment and fatty acid metal salt can be explained on the basis of Lewis's definition of acid and base. Namely, the center metal of the fatty acid metal salt is a Lewis acid and the lone electron pair present on a surface of the pigment is a Lewis base, and the adsorption is based on the interaction between those acid and base. As the charge of the center metal increases, stronger force for attracting the lone electron pair is yielded. According to the present invention, the effect is not obtained if it is not a polyvalent metal with valency of 2 or higher.

Furthermore, as described in the above, it is believed that the adsorption between the fatty acid metal salt and resin having an ionic functional group occurs on the basis of Lewis's definition of acid and base. Namely, the ionic functional group with acid dissociation constant pKa of at least 6.0 and not more than 9.0 is adsorbed, as a Lewis base, onto the metal of the fatty acid metal salt. In that case, it is believed that stronger adsorption between the fatty acid metal salt and the resin having an ionic functional group can be obtained as the complex stability between the fatty acid metal salt and the resin having an ionic functional group is higher. As for the resin having an ionic functional group, the same explanations as described in the above can be applied.

With regard to the carbon atom number of the fatty acid of the fatty acid metal salt, which is used for the process for producing a toner of the present invention, the effect of improving tinting strength is not obtained unless it is at least 8 and not more than 28. That is because, if the carbon atom number is less than 8, polarity of the fatty acid increases, and if the carbon atom number is more than 28, it is difficult for the fatty acid metal salt to get dissolved in a polymerizable monomer or am organic solvent so that the ability of providing the pigment with the affinity for a solvent and the binder resin is weakened. As for the fatty acid metal salt, the same explanations as described in the above can be applied.

As for the center metal, those well known to have valency of 2 or higher can be used, and the center metals described in the above can be used. With regard to a typical element, those having higher valency and smaller ionic radius have higher complex stability, and thus Al, Ba, Ca, Mg, and Zn are preferable. In addition to them, a transition metal such as Fe, Ti, Co, and Zr can have a stable unpaired electron in d orbital and has high complex stability, and therefore desirable. Among them, Al, Mg, Zn, Fe, Ti, and Co are particularly preferable.

As described in the above, the hydrophobicity parameter HP of the resin having an ionic functional group is preferably at least 0.55. As the hydrophobicity parameter HP is at least 0.55, the ability of providing the pigment with the affinity for a solvent and the binder resin increases and the effect of inhibiting generation of an empty shell also increases. More preferably, the hydrophobicity parameter HP is at least 0.60.

Furthermore, for the purpose of controlling the hydrophobicity parameter HP as described above, it is preferable that the resin having an ionic functional group has, in the molecule, a carboxylic acid ester group which is represented by the above Formula (2).

The content of the carboxylic acid ester group which is represented by the Formula (2) in one molecule of the resin having an ionic functional group is preferably at least 1% by mol and not more than 30% by mol based on the entire monomer units of the resin having an ionic functional group. Accordingly, more favorable balance between the ability of providing the pigment, with the affinity for a solvent and the binder resin and the adsorption performance for the metal is obtained. The content is more preferably at least 4% by mol and not more than 10% by mol.

The main chain structure of the resin having an ionic functional group is the same as described above.

The weight average molecular weight Mw of the resin having an ionic functional group is preferably at least 10,000 and not more than 75,000. When it is at least 10,000, the pigment dispersion effect based on diffusion of a polymer chain is improved. When it is not more than 75,000, the polymer number can be maintained even at the time of adding the same amount, and also it is easier to obtain the pigment dispersion effect. More preferably, the weight average molecular weight is at least 10,000 and not more than 50,000.

For the process for producing a toner of the present invention, the addition amount of the fatty acid metal salt for obtaining the effect of improving the tinting strength is preferably at least 0.5 parts by mass relative to 100 parts by mass of the pigment. When it is at least 0.5 parts by mass relative to the pigment, a sufficient adsorption amount to the pigment is obtained. Furthermore, the addition amount of the resin having an ionic functional group is preferably at least 30 parts by mass relative to 100 parts by mass of the fatty acid metal salt. In that case, the adsorption amount onto a metal is sufficient so that the effect of improving the tinting strength is high. In any case, from the viewpoint of the solubility in the binder resin, the addition amount is preferably not more than 10 parts by mass relative to 100 parts by mass of the binder resin.

The polymerizable monomer, organic solvent, and pigment that are used for the process for producing a toner of the present invention are not particularly limited, and those explained in the above can be used, for example.

Hereinbelow, various measurement methods related to the present invention are described.

<pH and pKa of THF Solution>

0.100 g of a measurement sample is precisely weighed into a 250 ml tall beaker, and 150 ml of THF is added to the beaker to dissolve the sample over 30 minutes. A pH electrode is placed in this solution, and a pH of the THF solution of the sample is read. After that, a 0.1 mol/l potassium hydroxide-ethyl alcohol solution (manufactured by Kishida Chemical Co., Ltd.) is added by 10 μl to the solution, and a pH is read and titration is performed for every addition. The 0.1 mol/l potassium hydroxide-ethyl alcohol solution is added until the pH reaches 10 or higher and there is no pH change even when 30 μl of the potassium hydroxide-ethyl alcohol solution is added. The pH is plotted against the addition amount of the 0.1 mol/l potassium hydroxide-ethyl alcohol solution based on the obtained result, and a titration curve is obtained.

A pKa is determined as described below. A point at which the tilt of a pH change is the highest in the obtained titration curve is defined as a neutralization point, and a pH at a half of the amount of the 0.1 mol/l potassium hydroxide-ethyl alcohol solution required up to the neutralization point is read from the titration curve. The value of the read pH is defined as pKa.

<Method for Measuring Hydrophobicity Parameter HP>

The hydrophobicity parameter HP is measured as described below.

In a 8 ml sample bottle, 0.01 g of the resin having an ionic functional group is added and, after dissolving it in 1.48 g (1.0 ml) of chloroform, the initial mass (W1) is measured. A stirring bar is added to the sample bottle, and under stirring using a magnetic stirrer, (a) 100 mg of heptane is added dropwise thereto and stirring is continued for 20 seconds. (b) Presence of white turbidity is determined with a visual check. If there is no white turbidity, the operations of (a) and (b) are repeated. At a point confirmed with white turbidity (that is, precipitation point), the operations are terminated, and the mass (W2) is measured. Meanwhile, all the measurements are performed at 25° C. and normal pressure (that is, 1 atm).

HP is calculated according to the following equation. Furthermore, specific gravity of heptane at 25° C. at 1 atm is 0.684, and specific gravity of chloroform is 1.48.

$$HP=\{(W2-W1)/0.684\}/\{(W2-W1)/0.684)+1\}$$

The same measurement is performed 3 times, and the average value is obtained as HP.

<Measurement of Molecular Weight of Resin>

The molecular weight and molecular weight distribution of the resin used in the present invention are calculated in terms of polystyrene by gel permeation chromatography (GPC). In the case of measuring the molecular weight of a resin having an acidic group, the column elution rate also depends on the amount of an acidic group. As such, it is necessary to prepare in advance a sample of which acidic group is capped. For capping, methyl esterification is preferable, and a commercially available methyl esterification agent can be used. Specifically, a method of treating with trimethylsilidiazomethane can be mentioned.

Measurement of molecular weight by GPC is performed as described below. The resin is added to tefrahydrofuran (THF), and a solution kept for 24 hours at room temperature is filtered through a solvent-resistant membrane filter "Sample Pretreatment Cartridge" with pore diameter of 0.2 μm (manufactured by Tosoh Corporation) to give a sample solution. The measurement is performed under the following conditions. With regard to the preparation of a sample solution, the amount of THF is adjusted so as to have the resin concentration of 0.8% by mass. It is also possible; to use a basic solvent such as DMF if the resin is not easily dissolved in THF.

Instrument: HLC8120 GPC (detector: RI) (manufactured by Tosoh Corporation)

Columns: 7 column train of Shodex KF-801, 802, 803, 804, 805, 806 and 807 (manufactured, by Showa Denko K.K.)

Eluent: tetrahydrofuran (THF)

Flow rate: 1.0 ml/min

Oven temperature: 40.0° C.

Sample injection amount: 0.10 ml

For calculation of the molecular weight of a sample, a molecular weight calibration curve established by using the standard polystyrene resin column shown below is used. Specifically, it has product name of "TSK Standard Polystyrene F-850, F-450, F-288, F-128, F-80, F-40, F-20, F-10, F-4, F-2, F-1, A-5000, A-2500, A-1000, and A-500" manufactured by Tosoh Corporation.

<Method of Measuring Weight Average Particle Diameter (D4) of Toner>

The weight average particle diameter (D4) of the toner is determined as follows: a "Coulter Counter Multisizer 3" (registered trademark, manufactured by Beckman Coulter, Inc.), that is, a precision particle size distribution measurement instrument based on the pore electrical resistance method and equipped with a 100 μm aperture tube, is used, and the accompanying dedicated software "Beckman Coulter Multisizer 3 Version 3.51" (manufactured by Beckman Coulter, Inc.) is used to set the measurement conditions and analyze the measurement data. The measurements are carried at 25,000 channels for the number of effective measurement channels, and the calculation is made based on analysis of the measured data.

The aqueous electrolyte solution used for the measurements can be an aqueous electrolyte solution prepared by dissolving special-grade sodium chloride in ion exchange water to provide a concentration of 1% by mass and, for example, "Isoton II" (manufactured by Beckman Coulter, Inc.) can be used.

The dedicated software is configured as follows prior to measurement and analysis.

In the "modifying the standard measurement method (SOM)" screen in the dedicated software, the total count number in the control mode is set to 50,000 particles; the number of measurements is set to 1 time; and the Kd value is set to the value obtained by using "standard particle 10.0 μm" (manufactured by Beckman Coulter, Inc.). The threshold value and noise level are automatically set by pressing the "threshold value/noise level measurement button". In addition, the current is set to 1600 μA; the gain is set to 2; the electrolyte is set to Isoton II; and a check is entered for the "post-measurement aperture tube flush".

In the "setting conversion from pulses to particle diameter" screen of the dedicated software, the bin interval is set to logarithmic particle diameter; the particle diameter bin is set to 256 particle diameter bins; and the particle diameter range is set to at least 2 μm and not more than 60 μm.

The specific measurement procedure is as follows.

(1) Approximately 200 ml of the above-described aqueous electrolyte solution is introduced into a 250 ml round bottom glass beaker intended for exclusive use with the Multisizer 3 and this is placed in the sample stand and counterclockwise stirring with the stirrer rod is carried out at 24 rotations/sec. Contamination and air bubbles within the aperture tube are removed in advance by the "aperture flush" function of the dedicated software.

(2) Approximately 30 ml of the above-described aqueous electrolyte solution is introduced into a 100 ml flat bottom glass beaker. To this is added approximately 0.3 ml of a dilution prepared by the approximately 3-fold (mass) dilution with ion exchange water of the dispersing agent "Contaminon N" (a 10% by mass aqueous solution (pH 7) of a neutral detergent for cleaning precision measurement instrumentation, containing a nonionic surface active agent, anionic surface active agent and organic builder, manufactured by Wako Pure Chemical Industries, Ltd.).

(3) An "Ultrasonic Dispersion System Tetora 150" (manufactured by Nikkaki Bios Co., Ltd.), that is, an ultrasound disperser with an electrical output of 120 W equipped with two oscillators of oscillation frequency 50 kHz disposed such that the phases are displaced by 180°, is prepared. A pre-determined amount of ion exchange water is introduced into the water bath of the ultrasound disperser and approximately 2 ml of Contaminon N is added, to the water bath.

(4) The beaker described in (2) is set into the beaker holder opening of the ultrasound disperser and operation of the ultrasound disperser is started. The height position of the beaker is adjusted such that the resonance condition of the surface of the aqueous electrolyte solution within the beaker is at the maximum.

(5) While the aqueous electrolyte solution within the beaker of (4) is being irradiated with ultrasound, 10 mg of a toner is added to the aqueous electrolyte solution in small aliquots and dispersion is carried out. The ultrasound dispersion treatment is continued for an additional 60 seconds. The water temperature in the water bath is controlled as appropriate during ultrasound dispersion such that it is at least 10° C. and not more than 40° C.

(6) The dispersed toner-containing aqueous electrolyte solution of (5) is added dropwise by using a pipette into the round bottom beaker set in the sample stand as described in (1), and an adjustment is made to have a measurement, concentration of 5%. Measurement is then performed until the number of measured particles reaches 50,000.

(7) The measurement data is analyzed by the dedicated software provided with the instrument and the weight average particle diameter (D4) is calculated. Furthermore, when set to graph/volume % with the dedicated software, the "average diameter" on the analysis/volumetric statistical value (arithmetic average) screen corresponds to the weight average particle diameter (D4).

EXAMPLES

The present invention is described in detail hereinbelow using specific production methods, examples, and comparative examples, but in no way the present invention is limited to them. Furthermore, "parts" for the following blending is "parts by mass" in all cases.

<Synthesis Example of Polymerizable Monomer M-1>

78.6 g of 2,4-dihydroxybenzoic acid was dissolved in 400 ml of methanol, and 152.0 g of potassium carbonate was added thereto. The resultant was heated to 60° C. A solution in which 87.9 g of 4-(chloromethyl)styrene and 100 ml of methanol are mixed and dissolved was dropped to the reaction solution, and the resultant was allowed to react at 60° C. for 2.5 hours. The obtained reaction solution was cooled and then filtered and washed with methanol.

The obtained precipitates were dispersed in 1 L of water at pH 1 with hydrochloric acid. After that, they were filtered, washed with water and dried at 80° C. to obtain 55.7 g of the polymerizable monomer M-1 represented, by the following structural Formula (3).

(3)

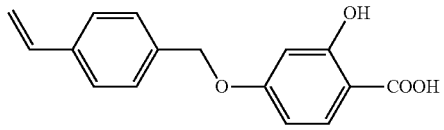

<Synthesis Example of Polymerizable Monomer M-2>

100 g of 2, 5-dihydroxybenzoic acid and 1441 g of 80% sulfuric acid were mixed by heating to 50° C. 144 g of tert-butyl alcohol was added to the dispersion solution and the mixture was stirred at 50° C. for 30 minutes. Then, the operation of adding 144 g of tert-butyl alcohol to the dispersion solution followed by stirring for 30 minutes was repeated 3 times. The reaction solution was cooled to room temperature and slowly poured into 1 kg of ice water. A precipitates were filtered and washed with water, and then washed with hexane. The resultant precipitates were dissolved in 200 ml of methanol and re-precipitated in 3.6 L of water. The resultant was filtered and then dried at 80° C. to obtain 74.9 g of a salicylic acid intermediate represented by the following structural Formula (4).

(4)

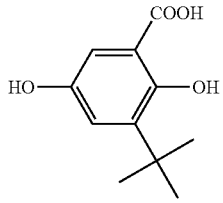

20.1 g of the polymerizable monomer M-2 represented by the following structural Formula (5) was obtained in the same manner as in the polymerizable monomer M-1 except that 76.6 g of 2,4-dihydroxybenzoic acid was changed, to 25.0 g of the salicylic acid intermediate represented by the above structural Formula (4).

(5)

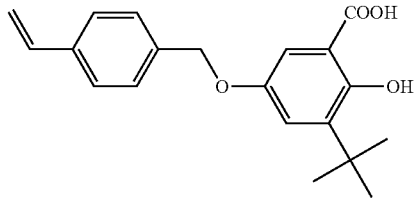

<Synthesis Example of Polymerizable Monomer M-3>

A salicylic acid intermediate was obtained by the same method as that of the synthesis of the polymerizable monomer M-2 except that 144 g of tert-butyl alcohol is changed to 253 g of 2-octanol. The polymerizable monomer M-3 represented by the following structural Formula (6) was obtained by the same method as that of the synthesis example of the polymerizable monomer M-2 except that 32 g of the salicylic acid intermediate obtained herein was used, (6)

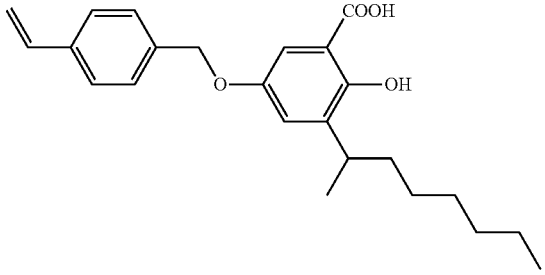

<Synthesis Example of Polymerizable Monomer M-4>

The polymerizable monomer M-4 represented by the following structural Formula (7) was obtained by the same method as that of the synthesis example of the polymerizable monomer M-1 except that 78.6 g of 2, 4-dihydroxybenzoic acid is changed to 78.6 g of 2,3-dihydroxybenzoic acid.

(7)

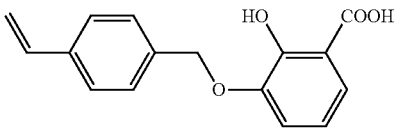

<Synthesis Example of Polymerizable Monomer M-5>

The polymerizable monomer M-5 represented by the following structural Formula (8) was obtained by the same method as that of the synthesis example of the polymerizable monomer M-1 except that 78.6 g of 2,4-dihydroxybenzoic acid is changed to 78.6 g of 2,6-dihydroxybenzoic acid.

(8)

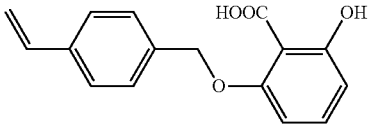

<Synthesis Example of Polymerizable Monomer M-6>

The polymerizable monomer M-6 represented by the following structural Formula (S) was obtained by the same method as that of the synthesis example of the polymerizable monomer M-1 except that 78.6 g of 2, 4-dihydroxybenzoic acid is changed to 78.6 g of 2,5-dihydroxy-3-methoxybenzoic acid.

(9)

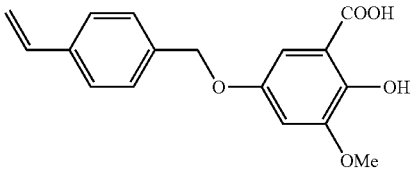

<Polymerizable Monomer M-7>

5-Vinyl salicylic acid was used as the polymerizable monomer M-7.

<Polymerizable Monomer M-8>

1-Vinylnaphthalene-2-carboxylic acid was used as the polymerizable monomer M-8.

<Polymerizable Monomer M-9> p-Styrene sulfonic acid was used as the polymerizable monomer M-9.

<Synthesis Example of Polymer A-1>

60.0 Parts of toluene were injected to a reaction vessel provided with a stirrer, a condenser, a thermometer, and a nitrogen introducing tube, and re fluxed under heating at 125° C. in a stream of nitrogen.

Next, the following raw materials and solvent were mixed to prepare a monomer mixture solution.

| | |
|---|---|
| styrene | 100 parts |
| polymerizable monomer M-1 | 8.62 parts |

-continued

| | |
|---|---|
| stearyl methacrylate | 25.2 parts |
| toluene | 60.0 parts |

The monomer mixture solution was admixed with 10.00 parts of tert-butylperoxy isopropyl monocarbonate (that is, 75% dilution product with hydrocarbon-based solvent) as a polymerization initiator, and the resultant was added dropwise to the above reaction vessel over 30 minutes. The reaction was allowed to occur under reflux with heating, and the temperature was lowered to room temperature when desired molecular weight was achieved. The obtained composition containing polymer was added dropwise to a mixture of 1400 parts of methanol and 10 parts of acetone to precipitate a resin composition. The obtained resin composition was filtered, washed 2 times with 200 parts of methanol, and dried at 60° C. under reduced pressure to obtain the polymer A-1. Molecular weight (Mw) of the obtained polymer A-1 was 32,000, pH of the THF solution was 5.4, pKa was 7.3, and hydrophobicity parameter was 0.75.

<Polymer A-2 to Polymer A-26>

The polymer A-2 to the polymer A-26 were synthesized in the same manner as in the synthesis example of the polymer A-1 except that type and amount of each monomer to be used, amount of a polymerization initiator, and polymerization temperature were suitably modified depending on the compositions shown in Table 1. Molecular weight, pH of a THF solution, pKa, and hydrophobicity parameter HP of each of the synthesized resins are described in Table 2.

<Synthesis Example of Metal-Containing Polymer B-1>

The metal-containing polymer B-1 was synthesized according to the method described in Japanese Patent Application Publication No. 2014-222356. To 519 ml of water, 90.6 g of 25.7% aqueous solution of aluminum sulfate was added followed by heating to 95° C. A solution obtained by adding 73.7 g of 20% aqueous solution of sodium hydroxide to 500 ml of water followed by adding 50.0 g of the polymerizable monomer M-1 and heating at 95° C. was added to the above solution over 25 minutes. Stirring under heating was performed for 3 hours. After that, filtering and water washing were performed, and according to drying for 48 hours at 80° C., 57.2 g of the metal-containing polymerizable monomer N-1 was obtained. After that, 60.0 parts of toluene were injected to a reaction vessel provided with a stirrer, a condenser, a thermometer, and a nitrogen introducing tube, and refluxed under heating at 125° C. in a stream of nitrogen.

Next, the following raw materials and solvent were mixed to prepare a monomer mixture solution.

| | |
|---|---|
| styrene | 100 parts |
| Metal-Containing polymerizable monomer N-1 | 31.7 parts |
| toluene | 60.0 parts |

The monomer mixture solution was admixed with 10.00 parts of tert-butylperoxy isopropyl monocarbonate (that is, 75% dilution product with hydrocarbon-based solvent) as a polymerization initiator, and the resultant was added dropwise to the above reaction vessel over 30 minutes. The reaction was allowed to occur under reflux with heating, and the temperature was lowered to room temperature when desired molecular weight was achieved. The obtained composition containing polymer was added dropwise to a mixture of 1400 parts of methanol and 10 parts of acetone to precipitate a resin composition. The obtained resin composition was filtered, washed 2 times with 200 parts of methanol, and dried at 60° C. under reduced pressure to obtain the metal-containing polymer B-1. Molecular weight (Mw) of the B-1 was 29,000, pKa was 7.3, and hydrophobicity parameter was 0.44.

TABLE 1

| | Monomer composition ratio (% by mol) | | | | | | | Polymerization conditions | |
|---|---|---|---|---|---|---|---|---|---|
| | Polymermizable monomer | | | | | | | | |
| Polymer type | Type | Composition ratio | Styrene | Stearyl methacrylate | Butyl methacrylate | Propyl methacrylate | Behenyl methacrylate | Amount of initiator | temperature |
| A-1 | M-1 | 3 | 90 | 7 | — | — | — | 10.0 | 125° C. |
| A-2 | M-1 | 3 | 87 | 10 | — | — | — | 10.0 | 125° C. |
| A-3 | M-1 | 1 | 92 | 7 | — | — | — | 10.0 | 125° C. |
| A-4 | M-1 | 5 | 88 | 7 | — | — | — | 10.0 | 125° C. |
| A-5 | M-1 | 5 | 91 | 4 | — | — | — | 10.0 | 125° C. |
| A-6 | M-1 | 5 | 95 | 0 | — | — | — | 10.0 | 125° C. |
| A-7 | M-1 | 2 | 91 | 7 | — | — | — | 10.0 | 125° C. |
| A-8 | M-1 | 7 | 83 | 10 | — | — | — | 10.0 | 125° C. |
| A-9 | M-1 | 10 | 80 | 10 | — | — | — | 10.0 | 125° C. |
| A-10 | M-1 | 3 | 90 | 7 | — | — | — | 30.0 | 100° C. |
| A-11 | M-1 | 3 | 90 | 7 | — | — | — | 30.0 | 90° C. |
| A-12 | M-1 | 3 | 90 | 7 | — | — | — | 5.0 | 125° C. |
| A-13 | M-1 | 3 | 90 | 7 | — | — | — | 4.0 | 120° C. |
| A-14 | M-2 | 3 | 90 | 7 | — | — | — | 10.0 | 125° C. |
| A-15 | M-2 | 3 | 87 | 10 | — | — | — | 10.0 | 125° C. |
| A-16 | M-2 | 3 | 82 | 15 | — | — | — | 10.0 | 125° C. |
| A-17 | M-3 | 3 | 90 | 7 | — | — | — | 10.0 | 125° C. |
| A-18 | M-4 | 3 | 90 | 7 | — | — | — | 10.0 | 125° C. |
| A-19 | M-5 | 3 | 90 | 7 | — | — | — | 10.0 | 125° C. |
| A-20 | M-6 | 3 | 90 | 7 | — | — | — | 10.0 | 125° C. |
| A-21 | M-7 | 3 | 90 | 7 | — | — | — | 10.0 | 125° C. |
| A-22 | M-8 | 3 | 90 | 7 | — | — | — | 10.0 | 125° C. |
| A-23 | M-1 | 3 | 90 | — | 7 | — | — | 10.0 | 125° C. |
| A-24 | M-1 | 3 | 90 | — | — | 7 | — | 10.0 | 125° C. |
| A-25 | M-1 | 3 | 90 | — | — | — | 7 | 10.0 | 125° C. |
| A-26 | M-9 | 3 | 90 | 7 | — | — | — | 10.0 | 125° C. |
| B-1 | N-1 | 5 | 95 | — | — | — | — | 10.0 | 125° C. |

TABLE 2

| | Weight average molecular weight (Mw) | Acid dissociation constant pKa | Hydrophobicity parameter HP | pH of THF solution |
|---|---|---|---|---|
| Polymer A-1 | 32000 | 7.3 | 0.75 | 5.4 |
| Polymer A-2 | 30000 | 7.4 | 0.83 | 5.5 |
| Polymer A-3 | 30000 | 7.1 | 0.90 | 4.8 |
| Polymer A-4 | 31000 | 7.3 | 0.68 | 5.4 |
| Polymer A-5 | 28000 | 7.2 | 0.57 | 5.2 |
| Polymer A-6 | 29000 | 7.2 | 0.44 | 5.2 |
| Polymer A-7 | 31000 | 7.4 | 0.81 | 5.5 |
| Polymer A-8 | 31000 | 7.3 | 0.65 | 5.4 |
| Polymer A-9 | 28000 | 7.1 | 0.52 | 5.0 |
| Polymer A-10 | 8000 | 6.9 | 0.77 | 4.7 |
| Polymer A-11 | 12000 | 7.1 | 0.78 | 5.0 |
| Polymer A-12 | 74000 | 7.5 | 0.77 | 5.8 |
| Polymer A-13 | 79000 | 7.5 | 0.78 | 5.9 |
| Polymer A-14 | 31000 | 7.3 | 0.81 | 5.4 |
| Polymer A-15 | 29000 | 7.4 | 0.88 | 5.5 |
| Polymer A-16 | 28000 | 7.4 | 0.94 | 5.5 |
| Polymer A-17 | 28000 | 7.3 | 0.82 | 5.4 |
| Polymer A-18 | 32000 | 7.6 | 0.78 | 6.0 |
| Polymer A-19 | 31000 | 7.8 | 0.78 | 6.2 |
| Polymer A-20 | 29000 | 8.1 | 0.78 | 6.5 |
| Polymer A-21 | 28000 | 6.6 | 0.76 | 4.3 |
| Polymer A-22 | 28000 | 8.8 | 0.76 | 6.8 |
| Polymer A-23 | 32000 | 7.2 | 0.63 | 5.2 |
| Polymer A-24 | 32000 | 7.2 | 0.61 | 5.2 |
| Polymer A-25 | 32000 | 7.4 | 0.88 | 5.5 |
| Polymer A-26 | 30000 | 0.3 | 0.73 | 0.1 |
| Polymer B-1 | 29000 | 7.3 | 0.44 | 5.4 |

<Production of Toner 1>

To 1300.0 parts by mass of ion exchange water which has been to a temperature of 60° C., 9-0 parts by mass of tripotassium phosphate were added, and according to stirring at stirring rate of 15,000 rpm by using a T.K. Homomixer (manufactured by Tokushu Kika Kogyo Co., Ltd.), an aqueous medium was prepared.

Furthermore, by using the following raw materials, a polymerizable monomer composition was prepared.

| | |
|---|---|
| styrene monomer | 78.0 parts by mass |
| n-butyl acrylate | 22.0 parts by mass |
| C.I. Pigment Blue 15:3 (manufactured by Dainichiseika Color & Chemicals Mfg. Co., Ltd.) | 7.5 parts by mass |
| polyester resin (polycondensation product of propylene oxide modified bisphenol A and phthalic acid, Tg = 75.9° C., Mw = 11,000, Mn = 4200, acid number: 11 mgKOH/g) | 5.0 parts by mass |
| hydrocarbon wax (Tm = 78° C.) | 9.0 parts by mass |
| polymer A-1 | 0.7 parts by mass |
| aluminum stearate (trade name of SA-1500, manufactured by Sakai Chemical Industry Co., Ltd.) | 0.5 parts by mass |

The above raw materials were dissolved and dispersed for 3 hours using Attriter (manufactured by Mitsui Miike Chemical Engineering Machinery, Co., Ltd.) to give a polymerizable monomer composition.

Subsequently, the above polymerizable monomer composition was added to the aqueous medium described above, and, as a polymerization initiator, perbutyl PV (10 hour half life temperature: 54.6° C. (manufactured by NOF Corporation)) 9.0 parts by mass, was added and then the resultant was stirred at a temperature of 60° C. for 20 minutes at stirring rate of 10,000 rpm by using a high speed stirring device T.K. Homomixer (manufactured by Tokushu Kika Kogyo Co., Ltd.) for granulation.

After that, stirring was performed at 100 rpm by using a propeller type stirring device, and the reaction was allowed to occur for 5 hours at 70° C. Thereafter, the temperature was raised to 80° C. and the reaction was further allowed to occur for 2 hours.

Next, 200.0 parts by mass of ion exchange water was added, and after removing a condensing tube, a distillation device was applied. Distillation was then performed, for 5 hours while the temperature inside the vessel is at 100° C. The distillation fraction was 700.0 parts by mass. When the distillation is completed, the temperature was lowered to 30° C., and by adding dilute hydrochloric acid to the inside of the vessel, pH was lowered to 1.5 to dissolve the dispersion stabilizer. Furthermore, by performing separation by filtration, washing and drying, the toner particle 1 having weight average particle diameter (D4) of 6.21 μm was obtained.

To 100.0 parts by mass of the above toner particle, 1.0 part by mass of hydrophobic silica fine particles, which have been treated with dimethyl silicone oil (number average particle diameter of primary particle: 7 nm), was added as an external additive and treated for 10 minutes using a FM mixer (manufactured by Nippon Coke & Engineering. Co., Ltd.) to obtain the toner 1.

<Production of Toner 2 to 47 and 50 to 56>

Except following the resin having an ionic functional group, fatty acid metal salt, and pigment formulations that are shown in Table 3, the toner 2 to 47 and 50 to 56 were obtained in the same manner as the toner 1.

<Production of Toner 48>

| | |
|---|---|
| styrene-acryl resin (copolymer of styrene:n-butyl acrylate = 78:22 (mass ratio)) (Mw = 30,000, Tg = 55° C.) | 100.0 parts by mass |
| methyl ethyl ketone | 100.0 parts by mass |
| ethyl acetate | 100.0 parts by mass |
| C.I. Pigment Blue 15:3 (manufactured by Dainichiseika Color & Chemicals Mfg. Co., Ltd.) | 7.5 parts by mass |
| polyester resin (polycondensation product of propylene oxide modified bisphenol A and phthalic acid, Tg = 75.9° C., Mw = 11,000, Mn = 4200, acid number: 11 mgKOH/g) | 5.0 parts by mass |
| hydrocarbon wax (Tm = 78° C.) | 9.0 parts by mass |
| polymer A-1 | 0.7 parts by mass |
| aluminum stearate (trade name of SA-1500, manufactured by Sakai Chemical Industry Co., Ltd.) | 0.5 parts by mass |

The above raw materials were dissolved and dispersed for 3 hours using Attriter (manufactured by Mitsui Miike Chemical Engineering Machinery, Co., Ltd.) to give a toner composition.

Meanwhile, an aqueous medium was prepared by adding 27.0 parts by mass of calcium phosphate to 3000.0 parts by mass of ion exchange waiter heated to a temperature of 60° C., and stirring these at stirring rate of 15,000 rpm by using a high speed stirring device T.K. Homomixer (manufactured by Tokushu Kika Kogyo Co., Ltd.). To the aqueous medium, the above pigment dispersion was added, and by stirring these for 15 minutes at stirring rate of 10,000 rpm using a high speed stirring device T.K. Homomixer (manufactured, by Tokushu Kika Kogyo Co., Ltd.) at a temperature of 65° C. and in $N_2$ atmosphere, a toner composition was granulated. After that, switching to a propeller type stirring device was made and the stirring rate of the stirring device was maintained at 100 rpm. After that, the condensing tube was removed and a distillation device for recovery of a fraction was mounted. Next, the temperature was raised until the temperature inside the vessel reaches 100° C. The temperature inside the vessel was maintained at 100° C. for 5.0 hours. When the distillation is completed, the temperature was lowered to 30° C., and by adding dilute hydrochloric acid to the inside of the vessel, pH was lowered to 1.5 to dissolve calcium phosphate. Furthermore, by performing separation by filtration, washing and drying, the toner particle 48 having weight average particle diameter (D4) of 6.21 μm was obtained.

To 100.0 parts by mass of the above toner particle, 1.0 part by mass of hydrophobic silica fine particles, which have been treated with dimethyl silicone oil (number average particle diameter of primary particle: 7 nm), was added as an external additive and treated for 10 minutes using a FM mixer (manufactured by Nippon Coke & Engineering. Co., Ltd.) to obtain the toner 48.

<Production of Toner 49>

| | |
|---|---|
| styrene-acryl resin (copolymer of styrene:n-butyl acrylate = 78:22 (mass ratio)) (Mw = 30,000, Tg = 55° C.) | 100.0 parts by mass |
| C.I. Pigment Blue 15:3 (manufactured by Dainichiseika Color & Chemicals Mfg. Co., Ltd.) | 7.5 parts by mass |
| hydrocarbon wax (Tm = 78° C.) | 9.0 parts by mass |
| polymer A-1 | 0.7 parts by mass |
| aluminum stearate (trade name of SA-1500, manufactured by Sakai Chemical Industry Co., Ltd.) | 0.5 parts by mass |

The above toner materials were subjected to sufficient pre-mixing using a FM mixer (manufactured by Nippon Coke & Engineering, Co., Ltd.). After melt kneading with a twin-screw extruder followed by cooling, they were coarsely crushed using a hammer mill to have particle diameter of 1 to 2 mm or so. Subsequently, pulverization was carried out using a pulverizer based on air jet mode. Furthermore, the obtained pulverized product was classified by a multi-grade classifier to obtain the toner particle 49 having weight average particle diameter (D4) of 6.46 μm.

To 100.0 parts by mass of the above toner particle, 1.0 part by mass of hydrophobic silica fine particles, which have been treated with dimethyl silicone oil (number average particle diameter of primary particle: 7 nm), was added as an external additive and treated for 10 minutes using a FM mixer (manufactured by Nippon Coke & Engineering. Co., Ltd.) to obtain the toner 49.

TABLE 3

| | Resin having an ionic functional group | | Fatty acid metal salt | | | Pigment | | Weight average particle |
|---|---|---|---|---|---|---|---|---|
| | Polymer type | Content (X parts by mass) | Type | Content (Y parts by mass) | Y/X | Pigment type | Addition amount (Parts by mass) | diameter D4 of toner particle (μm) |
| Toner 1 | A-1 | 0.70 | Aluminum stearate | 0.50 | 0.714 | Pigment Blue 15:3 | 7.5 | 6.21 |
| Toner 2 | A-2 | 0.70 | Aluminum stearate | 0.50 | 0.714 | Pigment Blue 15:3 | 7.5 | 6.28 |
| Toner 3 | A-3 | 0.70 | Aluminum stearate | 0.50 | 0.714 | Pigment Blue 15:3 | 7.5 | 6.32 |
| Toner 4 | A-4 | 0.70 | Aluminum stearate | 0.50 | 0.714 | Pigment Blue 15:3 | 7.5 | 6.22 |
| Toner 5 | A-5 | 0.70 | Aluminum stearate | 0.50 | 0.714 | Pigment Blue 15:3 | 7.5 | 6.52 |
| Toner 6 | A-6 | 0.70 | Aluminum stearate | 0.50 | 0.714 | Pigment Blue 15:3 | 7.5 | 6.35 |
| Toner 7 | A-7 | 0.70 | Aluminum stearate | 0.50 | 0.714 | Pigment Blue 15:3 | 7.5 | 6.24 |
| Toner 8 | A-8 | 0.70 | Aluminum stearate | 0.50 | 0.714 | Pigment Blue 15:3 | 7.5 | 6.26 |
| Toner 9 | A-9 | 0.70 | Aluminum stearate | 0.50 | 0.714 | Pigment Blue 15:3 | 7.5 | 6.44 |
| Toner 10 | A-10 | 0.70 | Aluminum stearate | 0.50 | 0.714 | Pigment Blue 15:3 | 7.5 | 6.01 |
| Toner 11 | A-11 | 0.70 | Aluminum stearate | 0.50 | 0.714 | Pigment Blue 15:3 | 7.5 | 6.14 |
| Toner 12 | A-12 | 0.70 | Aluminum stearate | 0.50 | 0.714 | Pigment Blue 15:3 | 7.5 | 6.23 |
| Toner 13 | A-13 | 0.70 | Aluminum stearate | 0.50 | 0.714 | Pigment Blue 15:3 | 7.5 | 6.33 |
| Toner 14 | A-14 | 0.70 | Aluminum stearate | 0.50 | 0.714 | Pigment Blue 15:3 | 7.5 | 6.22 |
| Toner 15 | A-15 | 0.70 | Aluminum stearate | 0.50 | 0.714 | Pigment Blue 15:3 | 7.5 | 6.29 |
| Toner 16 | A-16 | 0.70 | Aluminum stearate | 0.50 | 0.714 | Pigment Blue 15:3 | 7.5 | 6.41 |
| Toner 17 | A-17 | 0.70 | Aluminum stearate | 0.50 | 0.714 | Pigment Blue 15:3 | 7.5 | 6.21 |
| Toner 18 | A-18 | 0.70 | Aluminum stearate | 0.50 | 0.714 | Pigment Blue 15:3 | 7.5 | 6.12 |
| Toner 19 | A-19 | 0.70 | Aluminum stearate | 0.50 | 0.714 | Pigment Blue 15:3 | 7.5 | 6.18 |
| Toner 20 | A-20 | 0.70 | Aluminum stearate | 0.50 | 0.714 | Pigment Blue 15:3 | 7.5 | 6.19 |
| Toner 21 | A-21 | 0.70 | Aluminum stearate | 0.50 | 0.714 | Pigment Blue 15:3 | 7.5 | 6.20 |
| Toner 22 | A-22 | 0.70 | Aluminum stearate | 0.50 | 0.714 | Pigment Blue 15:3 | 7.5 | 6.19 |
| Toner 23 | A-23 | 0.70 | Aluminum stearate | 0.50 | 0.714 | Pigment Blue 15:3 | 7.5 | 6.20 |
| Toner 24 | A-24 | 0.70 | Aluminum stearate | 0.50 | 0.714 | Pigment Blue 15:3 | 7.5 | 6.13 |
| Toner 25 | A-25 | 0.70 | Aluminum stearate | 0.50 | 0.714 | Pigment Blue 15:3 | 7.5 | 6.21 |
| Toner 26 | A-1 | 0.70 | Aluminum stearate | 0.50 | 0.714 | Pigment Blue 15:3 | 7.5 | 6.22 |
| Toner 27 | A-1 | 0.70 | Aluminum stearate | 0.50 | 0.714 | Pigment Blue 15:3 | 7.5 | 6.21 |
| Toner 28 | A-1 | 0.70 | Aluminum stearate | 0.04 | 0.057 | Pigment Blue 15:3 | 7.5 | 6.29 |
| Toner 29 | A-1 | 0.70 | Aluminum stearate | 2.10 | 3.000 | Pigment Blue 15:3 | 7.5 | 6.39 |
| Toner 30 | A-1 | 0.10 | Aluminum stearate | 0.03 | 0.043 | Pigment Blue 15:3 | 7.5 | 6.09 |
| Toner 31 | A-1 | 5.00 | Aluminum stearate | 2.20 | 3.143 | Pigment Blue 15:3 | 7.5 | 6.21 |
| Toner 32 | A-1 | 5.50 | Aluminum stearate | 0.01 | 0.100 | Pigment Blue 15:3 | 7.5 | 6.32 |
| Toner 33 | A-1 | 0.70 | Aluminum stearate | 5.00 | 1.000 | Carbon Black | 9.0 | 6.01 |
| Toner 34 | A-1 | 0.70 | Aluminum stearate | 5.50 | 1.000 | Pigment Red 122 | 10.0 | 6.32 |
| Toner 35 | A-1 | 0.70 | Zinc stearate | 0.50 | 0.714 | Pigment Blue 15:3 | 7.5 | 6.11 |

TABLE 3-continued

| | Resin having an ionic functional group | | Fatty acid metal salt | | | Pigment | | Weight |
|---|---|---|---|---|---|---|---|---|
| | Polymer type | Content (X parts by mass) | Type | Content (Y parts by mass) | Y/X | Pigment type | Addition amount (Parts by mass) | average particle diameter D4 of toner particle (μm) |
| Toner 36 | A-1 | 0.70 | Magnesium stearate | 0.50 | 0.714 | Pigment Blue 15:3 | 7.5 | 6.22 |
| Toner 37 | A-1 | 0.70 | Iron stearate | 0.50 | 0.714 | Pigment Blue 15:3 | 7.5 | 6.01 |
| Toner 38 | A-1 | 0.70 | Titan stearate | 0.50 | 0.714 | Pigment Blue 15:3 | 7.5 | 6.25 |
| Toner 39 | A-1 | 0.70 | Zirconium stearate | 0.50 | 0.714 | Pigment Blue 15:3 | 7.5 | 6.12 |
| Toner 40 | A-1 | 0.70 | Calcium stearate | 0.50 | 0.714 | Pigment Blue 15:3 | 7.5 | 6.22 |
| Toner 41 | A-1 | 0.70 | Cobalt stearate | 0.50 | 0.714 | Pigment Blue 15:3 | 7.5 | 6.15 |
| Toner 42 | A-1 | 0.70 | Barium stearate | 0.50 | 0.714 | Pigment Blue 15:3 | 7.5 | 6.11 |
| Toner 43 | A-1 | 0.70 | Aluminum octanoate | 0.50 | 0.714 | Pigment Blue 15:3 | 7.5 | 6.22 |
| Toner 44 | A-1 | 0.70 | Aluminum laurate | 0.50 | 0.714 | Pigment Blue 15:3 | 7.5 | 6.00 |
| Toner 45 | A-1 | 0.70 | Zinc behenate | 0.50 | 0.714 | Pigment Blue 15:3 | 7.5 | 6.34 |
| Toner 46 | A-1 | 0.70 | Aluminum montanate | 0.50 | 0.714 | Pigment Blue 15:3 | 7.5 | 6.33 |
| Toner 47 | A-1 | 0.70 | Aluminum oleinate | 0.50 | 0.714 | Pigment Blue 15:3 | 7.5 | 6.09 |
| Toner 48 | Described in the Description | | | | | | | |
| Toner 49 | Described in the Description | | | | | | | |
| Toner 50 | — | — | — | — | — | Pigment Blue 15:3 | 7.5 | 6.15 |
| Toner 51 | — | — | Aluminum stearate | 0.50 | — | Pigment Blue 15:3 | 7.5 | 6.23 |
| Toner 52 | A-26 | 0.70 | Aluminum stearate | 0.50 | 0.714 | Pigment Blue 15:3 | 7.5 | 6.11 |
| Toner 53 | A-26 | 0.70 | Aluminum stearate | 0.50 | 0.714 | Carbon Black | 9.0 | 6.11 |
| Toner 54 | A-26 | 0.70 | Aluminum stearate | 0.50 | 0.714 | Pigment Red 122 | 10.0 | 6.22 |
| Toner 55 | A-5 | 0.70 | — | — | — | Pigment Blue 15:3 | 7.5 | 6.08 |
| Toner 56 | A-1 | 0.70 | — | — | — | Pigment Blue 15:3 | 7.5 | 6.30 |

Examples 1 to 49 and Comparative Examples 1 to 7

By using the above toner 1 to 56, the below-described evaluations were performed. The results are given in Table 4.

By modifying the tandem mode laser beam printer LBP9660Ci manufactured by Canon Inc., which has the configuration shown in Table 1, it was made possible to have printing only with a cyan station. A modification was also made to set arbitrarily the back contrast. A modification was also made to enable setting of process speed, which was then set at 200 mm/sec.

Furthermore, to evaluate the tinting strength, a fixing device was removed so as to print a non-fixed image and to control the image density. The removed fixing device was modified such that it can also function as a fixing device itself, and also modified as an external fixing device such that it can control the process speed and temperature.

By using the toner cartridge for LBP9660Ci, the following evaluations were performed after filling 150 g of the toner 1. The same evaluations were made also for the toner 2 to 56.

<Evaluation of Fogging Latitude>

The above toner cartridge was left for 24 hours in each environment of low temperature and low humidity L/L (10° C./15% RH), normal temperature and normal humidity N/N (25° C./50% RH), and high temperature and high humidity H/H (32.5° C./85% RH). After keeping it for 24 hours in each environment, the toner cartridge was mounted in LBP9660Ci. After printing out as many as 17,000 pieces of an image with 1.0% print percentage on a A4 paper (in transverse direction), evaluation of fogging latitude was carried out at the initial stage and after the printing of 17,000 pieces (that is, after repeated use).

The back contrast was changed by 10 V pitch from 50 V to 400 V, and a completely blank image (that is, image with 0% print percentage) was printed for each. Then, after mounting an amber filter to "Reflectometer" (manufactured by Tokyo Denshoku Co., Ltd.), fogging was measured. Furthermore, this operation was performed at the initial stage and after printing of 17,000 pieces. To have the measured fogging value, the measured value of a completely blank image was subtracted from the measured value of non-used paper, and it corresponds to fogging density (%).

Figure 2A:
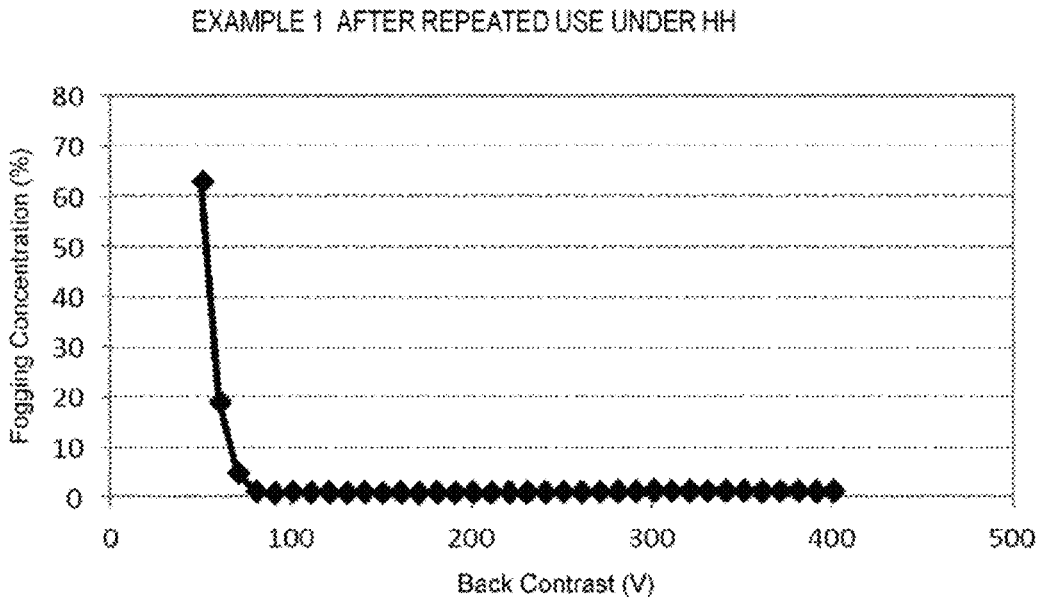
FIGS. 2A to 2D are examples illustrating the relationship between the back contrast and fogging in the present invention.
Figure 2B:
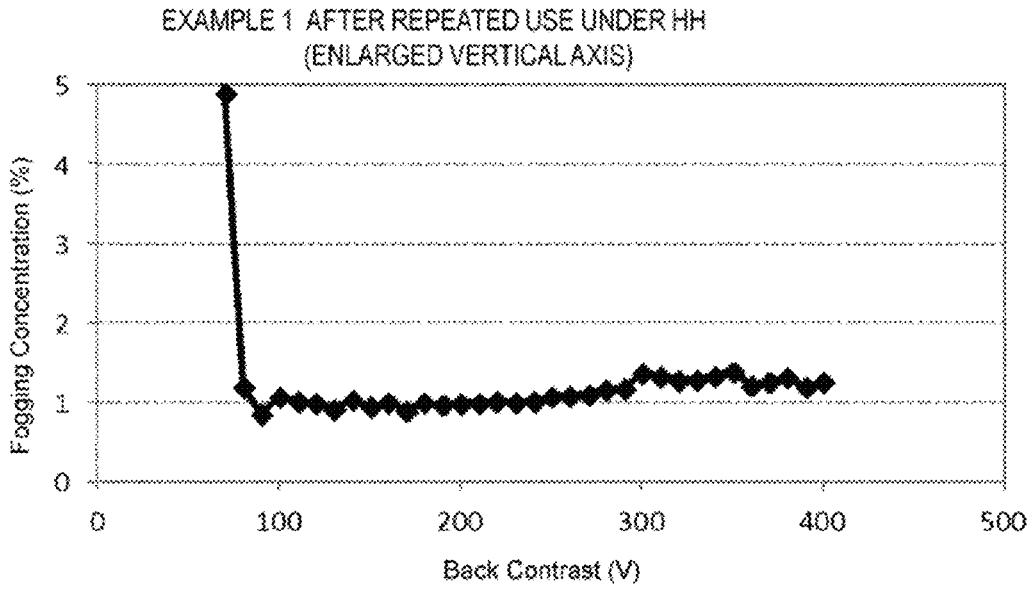
Figure 2C:
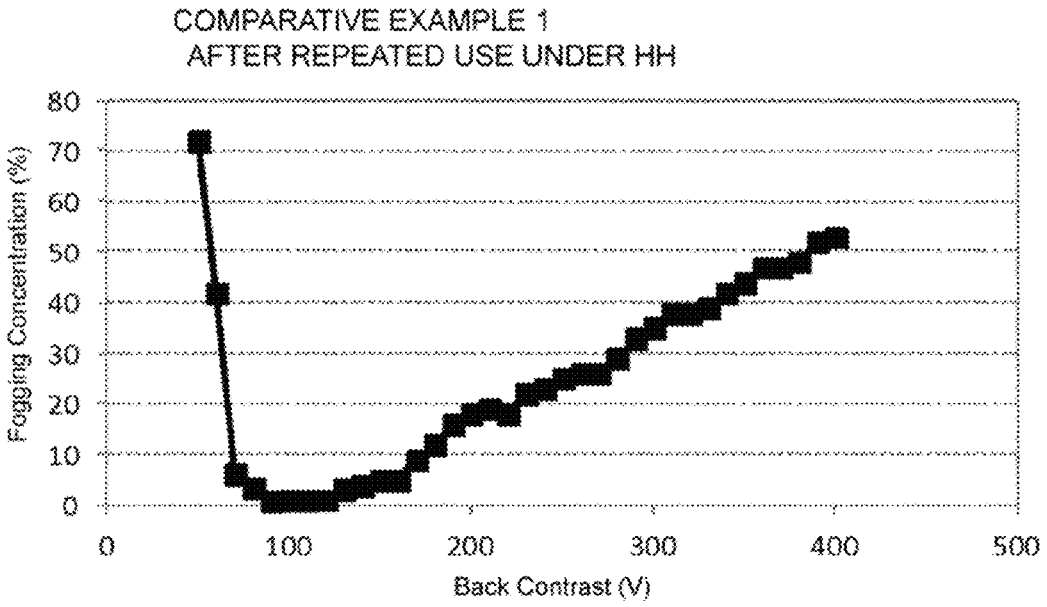
Figure 2D:
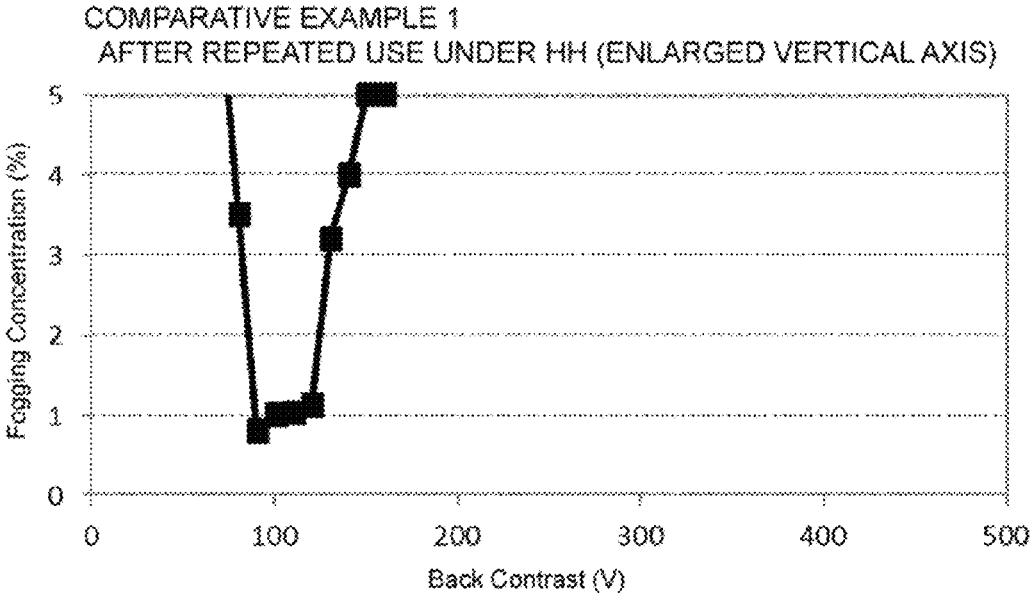

The measurement example is shown in FIGS. 2A to 2D, and a range in which the fogging density remains at 2.0% or less is defined as fogging latitude. Roughly, when the fogging density is more than 3.5%, there is tendency that it is recognized as an image problem. Thus, in each environment, when the fogging latitude in which the fogging density remains at 2.0% or less even after repeated use is more than 100 V, that is, C rank or above shown below, it was determined that the superiority of the fogging control design is exhibited.

A rank: Fogging latitude is not less than 250 V

B rank: Fogging latitude is at least 200 V but less than 250 V

C rank: Fogging latitude is at least 100 V but less than 200 V

D rank; Fogging latitude is at least 50 V but less than 100 V

E rank: Fogging latitude is less than 50 V

<Evaluation of Transferability>

A toner cartridge left for 24 hours in a high temperature and high humidity H/H (32.5° C./85% RH) environment was mounted to LBP9660Ci. Than, after printing out as many as 17,000 pieces of an image with 1.0% print percentage on a A4 paper (in transverse direction) (that is, after repeated use), evaluation of transferability after printing of 17,000 pieces (that is, after repeated use) was carried out. From a change in weight between the toner amount on a photosensitive member and the toner amount on a test paper at the time of printing out a solid image with the toner loading amount set at 0.45 mg/cm$^2$, transfer efficiency was obtained (when the entire amount of the toner on a photosensitive member is transferred onto a test paper, the transfer efficiency is 100%).

A rank: Transfer efficiency is at least 95.0%

B rank: Transfer efficiency is at least 90.0% but less than 95.0%

C rank: Transfer efficiency is at least 85.0% but less than 90.0%

D rank: Transfer efficiency is less than 85.0%

<Evaluation of Tinting Strength>

The above toner cartridge was mounted to LBP9660Ci, and a band-like image (width of 150 mm×length of 30 mm) was formed below a 30 mm blank on top of a transfer material. Furthermore, the setting was made such that the toner loading amount of the band-like image is 0.35 ma/cm$^2$. As a transfer material, A4 size GF-C081 (manufactured by Canon Inc., 81.4 g/m$^2$) was used.

10 pieces of a band-like image were printed, and by using an external fixing device of a color laser printer LBP9600Ci, fixing was carried out at process speed of 210 mm/sec and 150° C.

By measuring the image density of the fixed image obtained therefrom, tinting strength was evaluated.

Furthermore, for the measurement of image density, "Macbeth reflection densitometer RD918" (manufactured by GretagMacbeth GmbH) was used. Relative density was measured for the printout image on a blank part with original density of 0.00, and the measurement was made for 3 points for every fixed image, that is, left point, center point, and right point. Arithmetic mean of 10 pieces of the fixed image was used for the evaluation. Evaluation criteria were as follows.

A rank: Image density is at least 1.45

B rank: Image density is at least 1.35 but less than 1.45

C rank: Image density is at least 1.25 but less than 1.35

D rank: Image density is less than 1.25

TABLE 4

| | | Fogging latitude | | | | | | | | | | | | Transferability | | | |
|---|---|---|---|---|---|---|---|---|---|---|---|---|---|---|---|---|---|
| | | LL environment | | | | NN environment | | | | HH environment | | | | after | | | |
| Example | Toner | Initial stage | | After repeated use | | Initial stage | | After repeated use | | Initial stage | | After repeated use | | repeated use in HH environment | | Tinting strength | |
| Example 1 | Toner 1 | at least 320 V | A | at least 320 V | A | at least 320 V | A | at least 320 V | A | at least 320 V | A | at least 320 V | A | 96.1% | A | 1.49 | A |
| Example 2 | Toner 2 | at least 320 V | A | at least 320 V | A | at least 320 V | A | at least 320 V | A | at least 320 V | A | at least 320 V | A | 97.2% | A | 1.53 | A |
| Example 3 | Toner 3 | 290 V | A | 260 V | A | at least 320 V | A | 300 V | A | 280 V | A | 250 V | A | 97.5% | A | 1.45 | A |
| Example 4 | Toner 4 | at least 320 V | A | at least 320 V | A | at least 320 V | A | at least 320 V | A | at least 320 V | A | at least 320 V | A | 95.3% | A | 1.49 | A |
| Example 5 | Toner 5 | at least 320 V | A | at least 320 V | A | at least 320 V | A | at least 320 V | A | at least 320 V | A | 300 V | A | 92.6% | B | 1.46 | A |
| Example 6 | Toner 6 | at least 320 V | A | at least 320 V | A | at least 320 V | A | at least 320 V | A | at least 320 V | A | 290 V | A | 89.1% | C | 1.42 | B |
| Example 7 | Toner 7 | at least 320 V | A | at least 320 V | A | at least 320 V | A | at least 320 V | A | at least 320 V | A | 310 V | A | 95.8% | A | 1.50 | A |
| Example 8 | Toner 8 | at least 320 V | A | at least 320 V | A | at least 320 V | A | at least 320 V | A | at least 320 V | A | at least 320 V | A | 95.9% | A | 1.49 | A |
| Example 9 | Toner 9 | 290 V | A | 270 V | A | at least 320 V | A | at least 320 V | A | at least 320 V | A | 310 V | A | 88.2% | C | 1.47 | A |
| Example 10 | Toner 10 | at least 320 V | A | 210 V | B | at least 320 V | A | 250 V | A | at least 320 V | A | 200 V | B | 95.3% | A | 1.40 | B |
| Example 11 | Toner 11 | at least 320 V | A | 260 V | A | at least 320 V | A | 300 V | A | at least 320 V | A | 250 V | A | 95.4% | A | 1.46 | A |
| Example 12 | Toner 12 | 300 V | A | 290 V | A | at least 320 V | A | at least 320 V | A | 290 V | A | 280 V | A | 96.2% | A | 1.47 | A |
| Example 13 | Toner 13 | 240 V | B | 230 V | B | 300 V | A | 300 V | A | 230 V | B | 220 V | B | 96.3% | A | 1.43 | B |
| Example 14 | Toner 14 | at least 320 V | A | at least 320 V | A | at least 320 V | A | at least 320 V | A | at least 320 V | A | at least 320 V | A | 96.7% | A | 1.51 | A |
| Example 15 | Toner 15 | at least 320 V | A | at least 320 V | A | at least 320 V | A | at least 320 V | A | at least 320 V | A | at least 320 V | A | 97.5% | A | 1.56 | A |
| Example 16 | Toner 16 | 310 V | A | 300 V | A | at least 320 V | A | at least 320 V | A | 310 V | A | 290 V | A | 98.2% | A | 1.53 | A |

TABLE 4-continued

| | | Fogging latitude | | | | | | | | | | | | Transferability | | | |
|---|---|---|---|---|---|---|---|---|---|---|---|---|---|---|---|---|---|
| | | LL environment | | | | NN environment | | | | HH environment | | | | after | | | |
| Example | Toner | Initial stage | | After repeated use | | Initial stage | | After repeated use | | Initial stage | | After repeated use | | repeated use in HH environment | | Tinting strength | |
| Example 17 | Toner 17 | at least 320 V | A | 310 V | A | at least 320 V | A | at least 320 V | A | 310 V | A | 300 V | A | 95.8% | A | 1.46 | A |
| Example 18 | Toner 18 | at least 320 V | A | at least 320 V | A | at least 320 V | A | at least 320 V | A | at least 320 V | A | at least 320 V | A | 95.5% | A | 1.47 | A |
| Example 19 | Toner 19 | at least 320 V | A | at least 320 V | A | at least 320 V | A | at least 320 V | A | at least 320 V | A | at least 320 V | A | 95.3% | A | 1.47 | A |
| Example 20 | Toner 20 | at least 320 V | A | at least 320 V | A | at least 320 V | A | at least 320 V | A | at least 320 V | A | at least 320 V | A | 95.4% | A | 1.48 | A |
| Example 21 | Toner 21 | at least 320 V | A | 300 V | A | at least 320 V | A | at least 320 V | A | 310 V | A | 290 V | A | 95.8% | A | 1.46 | A |
| Example 22 | Toner 22 | 310 V | A | 300 V | A | at least 320 V | A | at least 320 V | A | 300 V | A | 280 V | A | 95.8% | A | 1.46 | A |
| Example 23 | Toner 23 | at least 320 V | A | at least 320 V | A | at least 320 V | A | at least 320 V | A | at least 320 V | A | at least 320 V | A | 93.8% | B | 1.47 | A |
| Example 24 | Toner 24 | at least 320 V | A | at least 320 V | A | at least 320 V | A | at least 320 V | A | at least 320 V | A | at least 320 V | A | 93.3% | B | 1.46 | A |
| Example 25 | Toner 25 | at least 320 V | A | at least 320 V | A | at least 320 V | A | at least 320 V | A | at least 320 V | A | at least 320 V | A | 97.5% | A | 1.54 | A |
| Example 26 | Toner 26 | 280 V | A | 240 V | B | 310 V | A | 290 V | A | 270 V | A | 230 V | B | 96.1% | A | 1.48 | A |
| Example 27 | Toner 27 | 270 V | A | 240 V | B | 300 V | A | 280 V | A | 270 V | A | 240 V | B | 96.1% | A | 1.48 | A |
| Example 28 | Toner 28 | 230 V | B | 190 V | C | 280 V | A | 240 V | B | 220 V | B | 180 V | C | 96.2% | A | 1.42 | B |
| Example 29 | Toner 29 | 220 V | B | 190 V | C | 270 V | A | 240 V | B | 220 V | B | 190 V | C | 96.2% | A | 1.46 | A |
| Example 30 | Toner 30 | 240 V | B | 200 V | B | 310 V | A | 280 V | A | 240 V | B | 200 V | B | 95.2% | A | 1.39 | B |
| Example 31 | Toner 31 | 270 V | A | 230 V | B | at least 320 V | A | 310 V | A | 300 V | A | 270 V | A | 96.3% | A | 1.47 | A |
| Example 32 | Toner 32 | 240 V | B | 220 V | B | at least 320 V | A | 310 V | A | 290 V | A | 280 V | A | 96.5% | A | 1.49 | A |
| Example 33 | Toner 33 | at least 320 V | A | at least 320 V | A | at least 320 V | A | at least 320 V | A | at least 320 V | A | at least 320 V | A | 96.2% | A | 1.48 | A |
| Example 34 | Toner 34 | at least 320 V | A | at least 320 V | A | at least 320 V | A | at least 320 V | A | at least 320 V | A | at least 320 V | A | 96.1% | A | 1.47 | A |
| Example 35 | Toner 35 | at least 320 V | A | at least 320 V | A | at least 320 V | A | at least 320 V | A | at least 320 V | A | at least 320 V | A | 96.1% | A | 1.47 | A |
| Example 36 | Toner 36 | at least 320 V | A | at least 320 V | A | at least 320 V | A | at least 320 V | A | at least 320 V | A | at least 320 V | A | 96.2% | A | 1.49 | A |
| Example 37 | Toner 37 | at least 320 V | A | at least 320 V | A | at least 320 V | A | at least 320 V | A | at least 320 V | A | at least 320 V | A | 96.1% | A | 1.47 | A |
| Example 38 | Toner 38 | at least 320 V | A | at least 320 V | A | at least 320 V | A | at least 320 V | A | at least 320 V | A | at least 320 V | A | 96.0% | A | 1.48 | A |
| Example 39 | Toner 39 | at least 320 V | A | at least 320 V | A | at least 320 V | A | at least 320 V | A | at least 320 V | A | at least 320 V | A | 96.1% | A | 1.47 | A |
| Example 40 | Toner 40 | at least 320 V | A | at least 320 V | A | at least 320 V | A | at least 320 V | A | at least 320 V | A | at least 320 V | A | 96.2% | A | 1.49 | A |
| Example 41 | Toner 41 | at least 320 V | A | at least 320 V | A | at least 320 V | A | at least 320 V | A | at least 320 V | A | at least 320 V | A | 96.3% | A | 1.48 | A |
| Example 42 | Toner 42 | at least 320 V | A | at least 320 V | A | at least 320 V | A | at least 320 V | A | at least 320 V | A | at least 320 V | A | 96.2% | A | 1.48 | A |
| Example 43 | Toner 43 | 300 V | A | 270 V | A | at least 320 V | A | at least 320 V | A | 290 V | A | 260 V | A | 96.3% | A | 1.45 | A |
| Example 44 | Toner 44 | at least 320 V | A | at least 320 V | A | at least 320 V | A | at least 320 V | A | at least 320 V | A | at least 320 V | A | 96.1% | A | 1.48 | A |
| Example 45 | Toner 45 | at least 320 V | A | at least 320 V | A | at least 320 V | A | at least 320 V | A | at least 320 V | A | at least 320 V | A | 96.2% | A | 1.48 | A |
| Example 46 | Toner 46 | at least 320 V | A | at least 320 V | A | at least 320 V | A | at least 320 V | A | 300 V | A | 270 V | A | 96.3% | A | 1.45 | A |
| Example 47 | Toner 47 | 310 V | A | 280 V | A | at least 320 V | A | at least 320 V | A | 290 V | A | 260 V | A | 96.3% | A | 1.45 | A |
| Example 48 | Toner 48 | at least 320 V | A | at least 320 V | B | at least 320 V | A | at least 320 V | A | at least 320 V | A | at least 320 V | A | 96.2% | A | 1.49 | A |
| Example 49 | Toner 49 | 280 V | A | 230 V | B | 310 V | A | 270 V | A | 260 V | A | 210 V | B | 94.5% | B | 1.44 | B |
| Comparative Example 1 | Toner 50 | 140 V | C | 40 V | E | 170 V | C | 100 V | C | 140 V | C | 40 V | E | 84.5% | D | 1.19 | D |
| Comparative Example 2 | Toner 51 | 140 V | C | 40 V | E | 170 V | C | 110 V | C | 140 V | C | 40 V | E | 84.9% | D | 1.23 | D |
| Comparative Example 3 | Toner 52 | 170 V | C | 70 V | D | 200 V | B | 130 V | C | 140 V | C | 70 V | D | 85.1% | C | 1.24 | D |
| Comparative Example 4 | Toner 53 | 170 V | C | 70 V | D | 200 V | B | 130 V | C | 140 V | C | 70 V | D | 85.0% | C | 1.24 | D |
| Comparative Example 5 | Toner 54 | 170 V | C | 70 V | D | 200 V | B | 130 V | C | 140 V | C | 70 V | D | 85.3% | C | 1.24 | D |
| Comparative Example 6 | Toner 55 | 150 V | C | 40 V | E | 210 V | B | 120 V | C | 160 V | C | 80 V | D | 92.3% | B | 1.29 | C |

TABLE 4-continued

| | | Fogging latitude | | | | | | | | | | | | Transferability | | | |
|---|---|---|---|---|---|---|---|---|---|---|---|---|---|---|---|---|---|
| | | LL environment | | | | NN environment | | | | HH environment | | | | after | | | |
| Example | Toner | Initial stage | | After repeated use | | Initial stage | | After repeated use | | Initial stage | | After repeated use | | repeated use in HH environment | | Tinting strength | |
| Comparative Example 7 | Toner 56 | 180 V | C | 90 V | D | 230 V | B | 150 V | C | 200 V | B | 110 V | C | 87.9% | C | 1.34 | C |

According to the present invention, a toner which can suppress fogging in a broad back contrast range in any environment including low temperature and low humidity environment to high temperature and high humidity environment, and which can exhibit its advantageous effects in sustained fashion through repeated use, can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-055321, filed Mar. 18, 2016, which is hereby incorporated by reference herein in its entirety.

What is claimed is:

1. A toner comprising a toner particle which contains a binder resin, a fatty acid metal salt, and a resin having an ionic functional group, wherein the fatty acid metal salt is a fatty acid metal salt of a polyvalent metal with valency of 2 or higher and a fatty acid with carbon atom number of 8 to 28, where the fatty acid metal salt is mixed in said toner particle with the binder resin and the resin having an ionic functional group, and the acid dissociation constant pKa of the resin having an ionic functional group is 6.0 to 9.0.

2. The toner according to claim 1, wherein

X is 0.10 to 5.00 when the content of the resin having the ionic functional group is X parts by mass, and a ratio Y/X is 0.050 to 3.000 when the content of the fatty acid metal salt is Y parts by mass relative to 100 parts by mass of the binder resin.

3. The toner according to claim 1, wherein weight average molecular weight (Mw) of the resin having the ionic functional group is 10,000 to 75,000.

4. The toner according to claim 1, wherein the polyvalent metal with valency of 2 or higher included in the fatty acid metal salt is selected from the group consisting of Al, Ba, Ca, Mg, Zn, Fe, Ti, Co, and Zr.

5. The toner according to claim 1, wherein hydrophobicity parameter HP of the resin having the ionic functional group is at least 0.55, where HP indicates the volume fraction ratio of heptane at precipitation point of the resin having the ionic functional group when heptane is added to a solution containing 0.01 parts by mass of the resin having the ionic functional group and 1.48 parts by mass of chloroform.

6. The toner according to claim 1, wherein the resin having the ionic functional group contains a polymer having an ionic functional group represented by Formula (1):

(1)

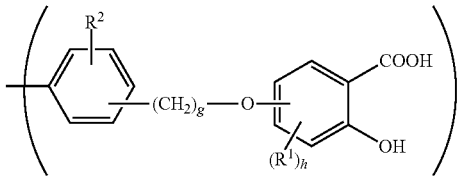

where $R^1$ each independently represents a hydroxyl group, a carboxy group, an alkyl group with carbon atom number of 1 to 18, or an alkoxy group with carbon atom number of 1 to 18; $R^2$ represents a hydrogen atom, a hydroxyl group, an alkyl group with carbon atom number of 1 to 18, or an alkoxy group with carbon atom number of 1 to 18; g is an integer of 1 to 3; and his an integer of 0 to 3.

7. The toner according to claim 1, wherein when 0.10 g of the resin having the ionic functional group is dissolved in 150 ml of tetrahydrofuran, pH of the tetrahydrofuran solution is less than 7.0.

8. A process for producing a toner comprising a toner particle which contains a binder resin, a pigment, a fatty acid metal salt, and a resin having an ionic functional group, wherein the fatty acid metal salt is a fatty acid metal salt of a polyvalent metal with valency of 2 or higher and a fatty acid with carbon atom number of 8 to 28, where the fatty acid metal salt is mixed in said toner particle with the binder resin and the resin having an ionic functional group, and the acid dissociation constant pKa of the resin having the ionic functional group is 6.0 to 9.0, the process comprising step (i) or (ii);

(i) a step in which a polymerizable monomer composition containing a pigment, a fatty acid metal salt, and a resin having an ionic functional group, and a polymerizable monomer for constituting a binder resin is granulated in an aqueous medium and the polymerizable monomer contained in the granulated particle is polymerized to give a toner particle; and (ii) a step in which a mixture solution containing a binder resin, a pigment, a fatty acid metal salt, and a resin having an ionic functional group, which is dissolved or dispersed in an organic solvent, is granulated in an aqueous medium and the organic solvent included in the granulated particle is removed to give a toner particle.

* * * * *